US010994292B2

(12) United States Patent
Dau et al.

(10) Patent No.: US 10,994,292 B2
(45) Date of Patent: May 4, 2021

(54) ELECTROSTATIC SPRAYING DEVICE

(71) Applicant: SUMITOMO CHEMICAL COMPANY, LIMITED, Tokyo (JP)

(72) Inventors: Van Thanh Dau, Southport (AU); Akiko Harada, Takarazuka (JP)

(73) Assignee: SUMITOMO CHEMICAL COMPANY, LIMITED, Tokyo (JP)

( * ) Notice: Subject to any disclaimer, the term of this patent is extended or adjusted under 35 U.S.C. 154(b) by 75 days.

(21) Appl. No.: 16/330,159

(22) PCT Filed: Sep. 4, 2017

(86) PCT No.: PCT/JP2017/031736
§ 371 (c)(1),
(2) Date: Mar. 4, 2019

(87) PCT Pub. No.: WO2018/043735
PCT Pub. Date: Mar. 8, 2018

(65) Prior Publication Data

US 2019/0184412 A1 Jun. 20, 2019

(30) Foreign Application Priority Data

Sep. 5, 2016 (JP) ..... JP2016-172888

(51) Int. Cl.
*B05B 5/053* (2006.01)
*B05B 5/08* (2006.01)
*B05B 5/025* (2006.01)

(52) U.S. Cl.
CPC ..... *B05B 5/053* (2013.01); *B05B 5/025* (2013.01); *B05B 5/08* (2013.01)

(58) Field of Classification Search
CPC ..... B05B 5/053; B05B 5/025; B05B 5/08
(Continued)

(56) References Cited

U.S. PATENT DOCUMENTS 4,476,515 A * 10/1984 Coffee ..... B05B 5/04 239/690
2004/0251326 A1* 12/2004 Pirrie ..... B05B 5/0533 239/690.1
(Continued)

FOREIGN PATENT DOCUMENTS

CN 101245531 A 8/2008
CN 202129158 U 2/2012
(Continued)

OTHER PUBLICATIONS

Extended European Search Report dated Apr. 3, 2020 for corresponding European Patent Application No. 17846738.7.
(Continued)

*Primary Examiner* — Steven J Ganey
(74) *Attorney, Agent, or Firm* — Foley & Lardner LLP

(57) ABSTRACT

An electrostatic spraying device includes: a high-voltage generation device for applying a voltage between a spray electrode and a reference electrode; and a controller that controls an output power of the high-voltage generation device based on operation environment information indicating at least one of (i) a surrounding environment of the device and (ii) an operation state of a power supply that supplies power to the device, independently of a current value and a voltage value at the spray electrode and the reference electrode.

10 Claims, 23 Drawing Sheets

(58) Field of Classification Search
USPC ..... 239/3, 690, 690.1
See application file for complete search history.

(56) References Cited

U.S. PATENT DOCUMENTS

| | | | | |
|---|---|---|---|---|
| 2008/0083842 | A1 | 4/2008 | Buchle | |
| 2009/0179093 | A1 | 7/2009 | Wada et al. | |
| 2011/0073686 | A1* | 3/2011 | Uegaki | B60H 3/0071 239/690 |
| 2014/0151471 | A1 | 6/2014 | Dau et al. | |
| 2015/0182978 | A1 | 7/2015 | Dau et al. | |
| 2016/0008829 | A1 | 1/2016 | Dau et al. | |

FOREIGN PATENT DOCUMENTS

| | | | |
|---|---|---|---|
| CN | 104192310 | A | 12/2014 |
| CN | 104487172 | A | 4/2015 |
| CN | 105073271 | A | 11/2015 |
| EP | 2 025 411 | A1 | 2/2009 |
| EP | 2 332 658 | A1 | 6/2011 |
| EP | 2 736 650 | A1 | 6/2014 |
| EP | 2 881 179 | A1 | 6/2015 |
| EP | 2 962 764 | A1 | 1/2016 |
| JP | 2007-326057 | A | 12/2007 |
| JP | 2013-027832 | A | 2/2013 |
| JP | 2014-168739 | A | 9/2014 |
| JP | 2014-233667 | A | 12/2014 |
| WO | WO-2013/018477 | A1 | 2/2013 |
| WO | WO-2014/112447 | A1 | 7/2014 |

OTHER PUBLICATIONS

English translation of the International Preliminary Report on Patentability dated Mar. 5, 2019 in corresponding application No. PCT/JP2017/031736.

Office Action and Search Report dated Jul. 3, 2020 for corresponding Chinese Patent Application No. 201780053831.7.

International Searching Authority, "International Search Report," issued in connection with International Patent Application No. PCT/JP2017/031736, dated Oct. 31, 2017.

International Searching Authority, "Written Opinion," issued in connection with International Patent Application No. PCT/JP2017/031736, dated Oct. 31, 2017.

Office Action dated Feb. 8, 2021 for corresponding Chinese Patent Application No. 201780053831.7.

Office Action dated Mar. 2, 2021 for corresponding Japanese Patent Application No. 2018-537582.

* cited by examiner

ELECTROSTATIC SPRAYING DEVICE

RELATED APPLICATIONS

The present application claims priority under 37 U.S.C. § 371 to International Patent Application No. PCT/JP2017/031736, filed Sep. 4, 2017, which claims priority to and the benefit of Japanese Patent Application No. 2016-172888, filed on Sep. 5, 2016. The contents of these applications are hereby incorporated by reference in their entireties.

TECHNICAL FIELD

The present invention relates to an electrostatic spraying device.

BACKGROUND ART

Conventionally, a spraying device for spraying a liquid in a container from a nozzle has been applied to a wide range of fields. An electrostatic spraying device that atomizes a liquid by electro hydrodynamics (EHD) and sprays it is known as this type of spraying device. This electrostatic spraying device generates an electric field in the vicinity of the tip of the nozzle and uses the electric field to atomize and spray the liquid at the tip of the nozzle. As a document disclosing such an electrostatic spraying device, Patent Document 1 is known.

The electrostatic spraying device of Patent Document 1 includes a current feedback circuit, and the current feedback circuit measures the current value of the reference electrode. Since in the electrostatic spraying device of Patent Document 1 the charge is balanced, this current value is measured and referenced so that the current at the spray electrode can be accurately identified. In the electrostatic spraying device of Patent Document 1, the stability of spraying is enhanced by using feedback control for keeping the current value at the spray electrode at a constant value.

PRIOR ART DOCUMENT

Patent Document

Patent Document 1: International Patent Publication No. 2013/018477 (Publication Date: Feb. 7, 2013)

SUMMARY OF INVENTION

Technical Problems

However, the electrostatic spraying device of Patent Document 1 has the following points which need to be improved.

Specifically, the electrostatic spraying device of Patent Document 1 needs to be provided with a current feedback circuit for performing feedback control, and the number of electronic components mounted on the substrate increases accordingly. Along with this, the electrostatic spraying device of Patent Document 1 increases the burden of circuit design and the manufacturing cost. Further, if in the electrostatic spraying device of Patent Document 1, there is no feedback circuit, there arises a problem that the spray stability is impaired.

The present invention has been made to solve the above problems, and an object thereof is to provide an electrostatic spraying device having a simple structure and an excellent spray stability.

Solutions to Problems

In order to solve the above problem, the electrostatic spraying device according to one aspect of the present invention is an electrostatic spraying device that, by applying a voltage between a first electrode and a second electrode, sprays liquid from the tip of the first electrode, the electrostatic spraying device including:

- a voltage applicator for applying the voltage between the first electrode and the second electrode; and
- a controller that controls the output power of the voltage applicator based on the operation environment information indicating at least one of (i) the surrounding environment of the device and (ii) the operation state of the power supply that supplies power to the device, independently of the current value and the voltage value at the first electrode and the second electrode.

In the conventional feedback control, for example, in the case of current feedback control, control depending on the operation state of the device is carried out by measuring the current value of the second electrode and applying feedback control so as to bring the measured value to a predetermined current value. Therefore, the conventional feedback control requires a feedback circuit, and the circuit structure (circuit configuration) becomes complicated. While there is no feedback circuit, spray stability is impaired.

On the other hand, in the electrostatic spraying device according to one aspect of the present invention, the controller controls the output power of the voltage applicator based on the operation environment information described above, independently from the current value and the voltage value at the first electrode and the second electrode (hereinafter this control may be referred to as "output power control").

The output power control can generate an electric field suitable for electrostatic spraying between the first electrode and the second electrode even when the resistance value of the first electrode is low. Therefore, the electrostatic spraying device according to one aspect of the present invention can maintain the spray amount and spray stability even under high humidity conditions where leakage current is likely to be generated between the first electrode and the second electrode. In addition, the spray amount and the spray stability of the electrostatic spraying device according to one aspect of the present invention are comparable to those of the conventional current feedback control and the like even under other conditions.

Accordingly, the electrostatic spraying device according to one aspect of the present invention does not need to have a feedback circuit which is conventionally thought to be necessary, and is capable of simplifying the circuit structure and greatly reducing the manufacturing cost.

As described above, the electrostatic spraying device according to one aspect of the present invention can provide an electrostatic spraying device with a simple structure and an excellent spray stability.

Further, in the electrostatic spraying device according to one aspect of the present invention,

- the voltage applicator may include
  - an oscillator for converting a direct current supplied from the power supply into an alternating current,
  - a transformer connected to the oscillator and converting the magnitude of a voltage, and
  - a converter circuit connected to the transformer and converting an alternating current into a direct current, wherein the controller may output to the oscillator a PWM signal (pulse width modulation signal) of which a duty cycle is set to be constant.

According to the above configuration, in the electrostatic spraying device according to the one aspect of the present invention, the controller outputs to the oscillator a PWM signal of which the duty cycle is set to be constant, in order to control the output power of the voltage applicator to be constant.

Accordingly, the electrostatic spraying device according to one aspect of the present invention performs output power control via the setting of the duty cycle of the PWM signal, and hence it can perform output power control without having a complicated circuit structure.

Further, in the electrostatic spraying device according to one aspect of the present invention, the controller may control the output power according to the duty cycle of the PWM signal.

According to the above configuration, the electrostatic spraying device according to one aspect of the present invention can perform output power control by changing the duty cycle of the PWM signal.

Further, in the electrostatic spraying device according to one aspect of the present invention, the operation environment information may include information indicating at least one of air temperature, humidity, and pressure around the device, and viscosity of the liquid, as information indicating the surrounding environment.

According to the above configuration, the electrostatic spraying device according to one aspect of the present invention can perform output power control using information indicating at least one of air temperature, humidity, and pressure around the device, and viscosity of the liquid as information indicating the surrounding environment (one instance of operation environment information).

Further, in the electrostatic spraying device according to one aspect of the present invention, the operation environment information may include information indicating the air temperature around the device, and the controller may control the output power according to the duty cycle of the PWM signal, increase the duty cycle of the PWM signal in response to rising of the air temperature and reduce the duty cycle of the PWM signal in response to dropping of the air temperature.

Under a general natural environment, humidity increases when the air temperature is high. Then, increasing humidity tends to generate a leakage current due to the influence of the electric charge charged around the first electrode, due to the influence of the moisture in the air. When the leakage current is generated, the resistance value of the first electrode decreases, making it difficult for an electric field suitable for electrostatic spraying to be generated between the first electrode and the second electrode.

In view of this, the electrostatic spraying device according to one aspect of the present invention increases the duty cycle of the PWM signal when the air temperature around the device increases, and increases the intensity of the electric field formed between the first electrode and the second electrode. Thereby, the electrostatic spraying device according to one aspect of the present invention can maintain the stability of spraying even when the air temperature around the device is high.

On the other hand, when the air temperature around the device is low, the high duty cycle of the PWM signal causes the power consumption of the device to increase. In this case, when a battery (dry cell) is used as a power supply for supplying power to the device for example, a long-time operation becomes difficult because of the finite amount of electric power to be stored in the battery.

In view of this, the electrostatic spraying device according to one aspect of the present invention reduces the duty cycle of the PWM signal when the air temperature around the device is lowered, thereby enabling operation over a long period of time. That is, the electrostatic spraying device according to one aspect of the present invention can maintain the stability of spraying in terms of long-term operation even when the air temperature around the device is low.

As described above, the electrostatic spraying device according to one aspect of the present invention has the above-described configuration, so that the spray stability can be maintained irrespective of the air temperature.

Further, in the electrostatic spraying device according to one aspect of the present invention, the controller may determine a spray interval for which a period of time during which the device sprays the liquid and a period of time during which it stops spraying are one cycle, based on the following formula (1).

[Math. 1]

$$Sprayperiod(T) = \left(1 + \frac{T - T_0}{100} * \text{Sprayperiod_compensation_rate}\right) * Sprayperiod(T_0) \quad (1)$$

where,

Sprayperiod(T): Spray interval (s (second)) for which the period of time during which the device sprays the liquid and the period of time during which it stops spraying at temperature T are one cycle T: Air temperature (° C.)

$T_0$: Initial setting temperature (° C.)

Sprayperiod_compensation_rate: Spray time compensation rate (−)

Sprayperiod($T_0$): Spray interval (s) for which the period of time during which the device sprays the liquid and the period of time during which it stops spraying at the initial setting temperature $T_0$ are one cycle.

The electrostatic spraying device according to one aspect of the present invention increases the spray interval with the period of time during which the device sprays the liquid and the period of time during which it stops spraying as one cycle, when the air temperature around the device rises. In addition, the electrostatic spraying device according to one aspect of the present invention reduces the spray interval with the period of time during which the device sprays the liquid and the period of time during which it stops spraying as one cycle, when the air temperature around the device drops.

Thus, the electrostatic spraying device according to one aspect of the present invention can maintain the spray stability irrespective of changes in air temperature.

In this instance, since the controller determines the spray interval by the calculation based on formula (1), it is possible to quickly and accurately determine the spray interval.

Further, in the electrostatic spraying device according to one aspect of the present invention, the controller may determine the time for turning on the PWM signal based on the following formula (2).

[Math. 2]

$$\text{PWM_ON_time}(T) = \left(1 + \frac{T - T_0}{100} * \text{PWM_compensation_rate}\right) * \text{PWM_ON_time}(T_0) \quad (2)$$

where,

PWM_ON_time(T): ON time (μs) of PWM signal

T: Air temperature (° C.)

PWM_compensation rate: PWM compensation factor (/° C.)

PWM_ON_time($T_0$): ON time (μs) of PWM signal at initial setting temperature $T_0$.

The electrostatic spraying device according to one aspect of the present invention lengthens the ON time of the PWM signal when the air temperature around the device becomes high. In addition, the electrostatic spraying device according to one aspect of the present invention shortens the ON time of the PWM signal when the air temperature around the device becomes low.

Thus, the electrostatic spraying device according to one aspect of the present invention can maintain the spray stability irrespective of changes in air temperature.

Further, since the controller determines the ON time of the PWM signal by the calculation based on formula (2), it is possible to quickly and accurately determine the ON time of the PWM signal.

Further, in the electrostatic spraying device according to one aspect of the present invention, the controller may increase the spray interval for which a period of time during which the device sprays the liquid and a period of time during which it stops spraying are one cycle and increase the duty cycle of the PWM signal in response to rising of the air temperature, and reduce the spray interval for which the period of time during which the device sprays the liquid and the period of time during which it stops spraying are one cycle and reduce the duty cycle of the PWM signal in response to dropping of the air temperature.

Generally, the viscosity of a liquid increases as the air temperature drops, and it decreases as the air temperature rises. Therefore, in consideration of the viscosity characteristics, the electrostatic spraying device according to one aspect of the present invention increases the duty cycle of the PWM signal when the air temperature around the device is high. Although this would increase the power consumption, increasing the spray interval suppresses the power consumption to achieve the balance.

Similarly, the electrostatic spraying device according to one aspect of the present invention reduces the spraying interval when the air temperature around the device is low. Although this would increase the power consumption, reducing the duty cycle of the PWM signal suppresses the power consumption to achieve the balance.

Then, the stability of the spray is maintained by adjusting the duty cycle of the PWM signal or the spray interval according to the air temperature around the device.

As described above, the electrostatic spraying device according to one aspect of the present invention achieves a highly stable operation over a long period of time while achieving the balance of electric power consumption and taking into consideration the viscosity characteristics of the liquid.

Further, in the electrostatic spraying device according to one aspect of the present invention, the operation environment information may include information indicating the magnitude of at least one of the voltage and the current supplied from the power supply to the voltage applicator, as information indicating the operation state of the power supply.

According to the above configuration, the electrostatic spraying device according to one aspect of the present invention can perform output power control using information indicating the magnitude of at least one of the voltage and the current supplied from the power supply to the voltage applicator, as information indicating the operation state of the power supply (one instance of the operation environment information).

As described above, the electrostatic spraying device according to one aspect of the present invention can perform output power control without necessarily using information indicating the surrounding environment of the device as operation environment information.

In addition, the electrostatic spraying device according to one aspect of the present invention may further include a conversion circuit for converting the magnitude of a voltage supplied from the power supply to the voltage applicator, wherein the conversion circuit may be provided between the power supply and the voltage applicator, and the controller may control the output power by giving, to the conversion circuit, a command to increase or decrease a conversion magnification of the voltage in the conversion circuit.

According to the above configuration, the electrostatic spraying device according to one aspect of the present invention can perform output power control by increasing or decreasing the voltage conversion magnification in the conversion circuit.

In this manner, the electrostatic spraying device according to one aspect of the present invention can perform output power control by a method other than changing the duty cycle of the PWM signal.

Advantageous Effects of Invention

As described above, the electrostatic spraying device according to one aspect of the present invention is an electrostatic spraying device in which the voltage is applied between the first electrode and the second electrode to spray liquid from the tip of the first electrode, the electrostatic spraying device including:

the voltage applicator for applying the voltage between the first electrode and the second electrode; and the controller that controls the output power of the voltage applicator based on the operation environment information indicating at least one of (i) the surrounding environment of the device and (ii) the operation state of the power supply that supplies power to the device, independently of the current value and the voltage value at the first electrode and the second electrode.

Therefore, the electrostatic spraying device according to one aspect of the present invention can provide an electrostatic spraying device excellent in spray stability with a simple structure.

MODE FOR CARRYING OUT THE INVENTION

First Embodiment

Figure 1:
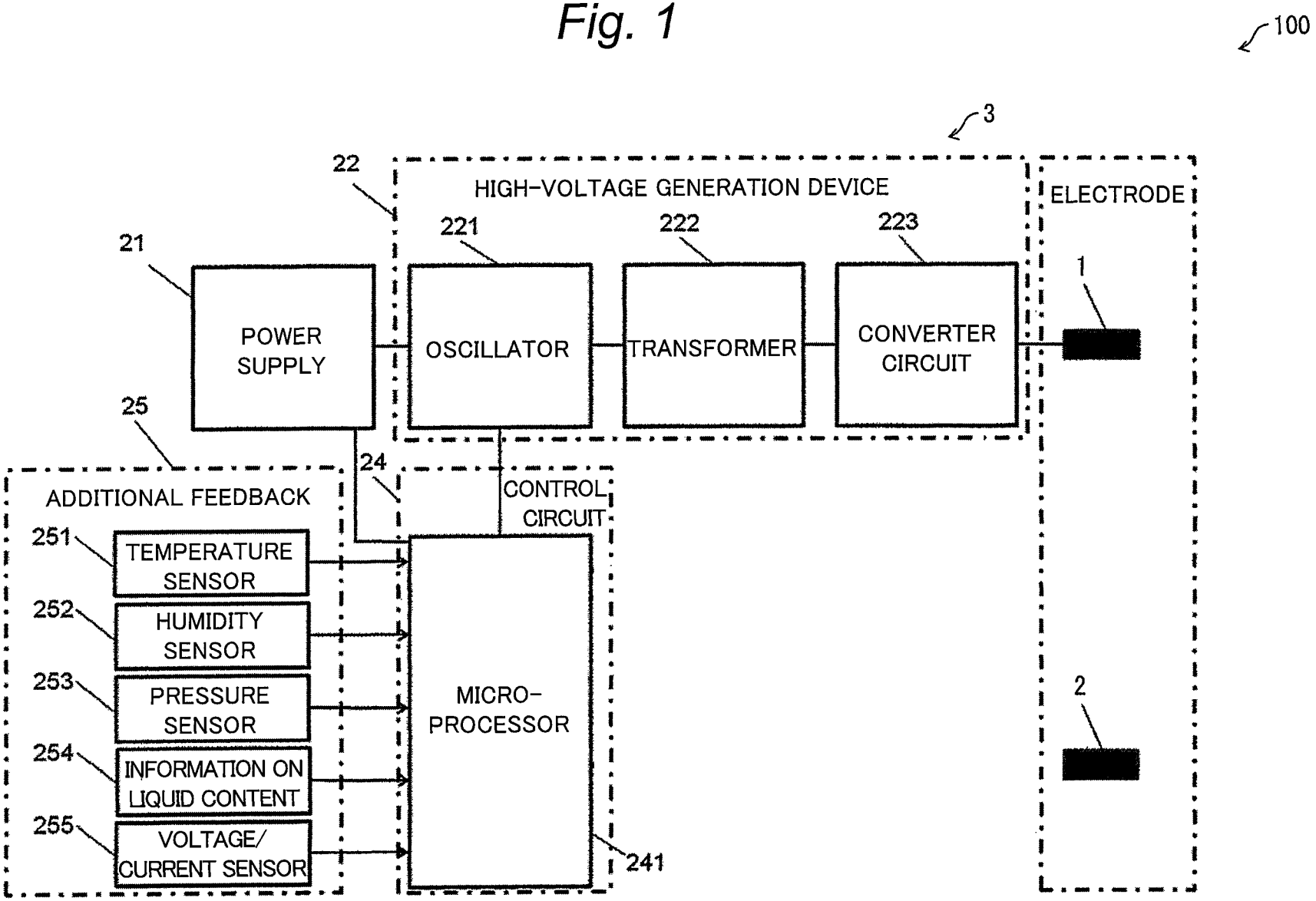
FIG. 1 is a configuration diagram of an electrostatic spraying device according to a first embodiment of the present invention.

Hereinafter, an electrostatic spraying device 100 according to the first embodiment will be described with reference to the drawings. In the following description, the same components and constituent elements are denoted by the same reference numerals. The same is true for their names and functions. Therefore, a detailed description thereof will not be repeated.

As will be described below, in the present embodiment, a configuration in which the output power of a high-voltage generation device (voltage applicator) 22 is controlled (performed output power control) by the duty cycle of the PWM signal (pulse width modulation signal) will be described.

Regarding Electrostatic Spraying Device 100

The electrostatic spraying device 100 is a device used for spraying fragrance oil, chemical substances for agricultural products, medicines, agricultural chemicals, insecticides, air cleaning chemicals and the like, for example. As shown in FIG. 1, the electrostatic spraying device 100 includes a spray electrode (first electrode) 1, a reference electrode (second electrode) 2, and a power supply device 3.

Figure 2:
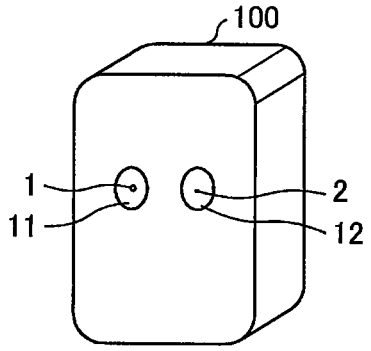
FIG. 2 is a view for explaining the appearance of the electrostatic spraying device according to the first embodiment of the present invention.

First, the appearance of the electrostatic spraying device 100 will be described with reference to FIG. 2. FIG. 2 is a view for explaining the appearance of the electrostatic spraying device 100.

As shown in the drawing, the electrostatic spraying device 100 has a rectangular shape. The spray electrode 1 and the reference electrode 2 are disposed on one side of the device. The spray electrode 1 is located in the vicinity of the reference electrode 2. In addition, an annular opening 11 is formed so as to surround the spray electrode 1. An annular opening 12 is formed so as to surround the reference electrode 2.

A voltage is applied between the spray electrode 1 and the reference electrode 2, whereby an electric field is generated between the spray electrode 1 and the reference electrode 2. Positively charged droplets are sprayed from the spray electrode 1. The reference electrode 2 ionizes air near the electrode and negatively charges the air. Then, the negatively charged air moves away from the reference electrode 2 by the electric field generated between the electrodes and the repulsive force between the negatively charged air particles. This movement produces a flow of air (hereinafter also referred to as ion flow in some cases). Based on this ion flow, positively charged droplets are sprayed in a direction away from the electrostatic spraying device 100.

The electrostatic spraying device 100 may have other shapes than rectangular shapes. In addition, the opening 11 and the opening 12 may have shapes different from those of the annular shape, and the opening dimensions thereof may be appropriately adjusted.

Regarding Spray Electrode 1 and Reference Electrode 2

Figure 3:
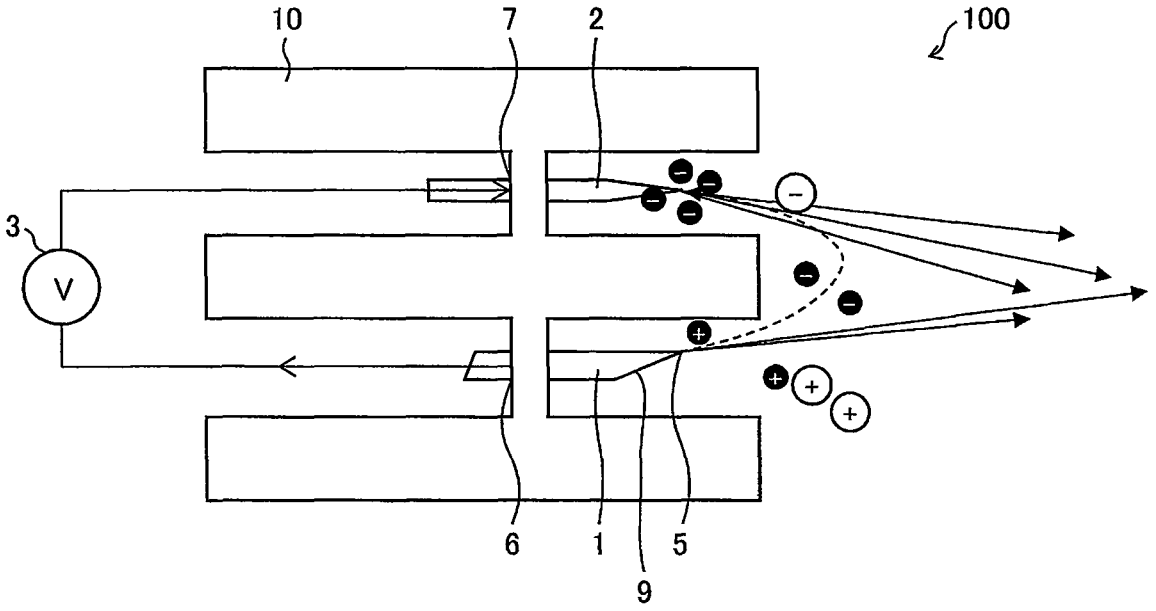
FIG. 3 is a view for explaining a spray electrode and a reference electrode.

The spray electrode 1 and the reference electrode 2 will be described with reference to FIG. 3. FIG. 3 is a view for explaining the spray electrode 1 and the reference electrode 2.

The spray electrode 1 has a conductive conduit such as a metallic capillary (for example, 304 type stainless steel, etc.) and a tip portion 5, which is a tip portion. The spray electrode 1 is electrically connected to the reference electrode 2 via the power supply device 3. A sprayed substance (hereinafter referred to as "liquid") is sprayed from the tip portion 5. The spray electrode 1 has an inclined surface 9 which is inclined with respect to the axis center of the spray electrode 1, and its shape is pointed with the tip thereof being thinner toward the tip portion 5.

The reference electrode 2 is made of a conductive rod such as a metal pin (for example, 304 type steel pin, etc.) and the like. The spray electrode 1 and the reference electrode 2 are spaced apart from each other at regular intervals and are arranged in parallel to each other. The spray electrode 1 and the reference electrode 2 are arranged, for example, at an interval of 8 mm from each other.

The power supply device 3 applies a high voltage between the spray electrode 1 and the reference electrode 2. For example, the power supply device 3 applies a high voltage within 1 to 30 kV (e.g., 3 to 7 kV) between the spray electrode 1 and the reference electrode 2. When a high voltage is applied, an electric field is generated between the electrodes, and an electric dipole is generated inside a dielectric 10. At this time, the spray electrode 1 is positively charged and the reference electrode 2 is negatively charged (or vice versa). Then, a negative dipole occurs on the surface of the dielectric 10 closest to the positive spray electrode 1 and a positive dipole occurs on the surface of the dielectric 10 closest to the negative reference electrode 2. At this time, the charged gas and substance species are released by the spray electrode 1 and the reference electrode 2. Here, as described above, the electric charge generated in the reference electrode 2 is a charge having a polarity opposite to the polarity of the liquid. Accordingly, the charge of the liquid is balanced by the charge generated in the reference electrode 2. Therefore, the electrostatic spraying device 100 can achieve stability of spraying based on the principle of charge equilibrium.

The dielectric 10 is made of a dielectric material such as nylon 6, nylon 11, nylon 12, polypropylene, nylon 66 or polyacetyl-polytetrafluoroethylene mixture. The dielectric 10 supports the spray electrode 1 at a spray electrode attachment portion 6 and supports the reference electrode 2 at a reference electrode attachment portion 7.

Regarding Power Supply Device 3

The power supply device 3 will be described with reference to FIG. 1. FIG. 1 is a configuration diagram of the electrostatic spraying device 100.

The power supply device 3 includes a power supply 21, the high-voltage generation device 22, and a control circuit (controller) 24.

The power supply 21 supplies power necessary for operation of the electrostatic spraying device 100. The power supply 21 may be a well-known power supply and includes a main power supply or one or more batteries. The power supply 21 is preferably a low-voltage power supply or a direct current (DC) power supply, and is configured by combining one or more dry batteries, for example. The number of batteries depends on the required voltage level and the power consumption of the power supply. The power supply 21 supplies DC power (in other words, DC current and DC voltage) to an oscillator 221 of the high-voltage generation device 22.

The high-voltage generation device 22 includes the oscillator 221, a transformer 222, and a converter circuit 223. The oscillator 221 converts DC power into AC power (in other words, AC current and AC voltage). The transformer 222 is connected to the oscillator 221. The transformer 222 converts the magnitude of the voltage of the alternating current (or the magnitude of the alternating current). The converter circuit 223 is connected to the transformer 222. The converter circuit 223 generates a desired voltage and converts AC power into DC power. Normally, the converter circuit 223 includes a charge pump and a rectifier circuit. A typical converter circuit is the Cockroft-Walton circuit.

A control circuit 24 outputs a PWM signal set to a constant value to the oscillator 221. The PWM is a method of controlling current and voltage by changing the time (pulse width) for outputting a pulse signal. The pulse signal is an electric signal that repeats ON and OFF, and is represented by, for example, a square wave. The pulse width, which is the output time of the voltage, is represented by the horizontal axis of the square wave.

The PWM system uses a timer that operates at a constant cycle. The pulse width is controlled by setting, to this timer, the position at which the pulse signal is turned ON. The ratio of turning ON in a constant cycle is called a "duty cycle" (also referred to as a "duty ratio").

The control circuit 24 includes a microprocessor 241 to accommodate various applications. The microprocessor 241 may be designed to further adjust the duty cycle of the PWM signal based on other feedback information (operation environment information) 25. The feedback information 25 includes environmental conditions (air temperature, humidity, and/or atmospheric pressure), liquid amount, arbitrary setting by the user, and the like. The information is provided as analog information or digital information and processed by the microprocessor 241. The microprocessor 241 may be designed to be also capable of performing compensation to improve the quality and stability of the spray by changing one of the spray interval, the time of turning on the spray, and the applied voltage, based on input information.

As an example, the power supply device 3 includes a temperature detection element such as a thermistor used for temperature compensation. In this instance, the power supply device 3 changes the spray interval according to the change in the temperature detected by the temperature detection element. The spray interval is a spray interval for which a period of time during which the electrostatic spraying device 100 sprays the liquid and a period of time during which it stops spraying are one cycle. For example, a case of a periodic spray interval in which the period of time of spraying (ON) is 35 seconds (during which the power supply applies a high voltage between the first electrode and the second electrode), the period of time of stopping the spraying (OFF) is 145 seconds (during which the power supply does not apply a high voltage between the first electrode and the second electrode) will be considered. In this case, the spray interval is 35 seconds+145 seconds=180 seconds.

The spray interval can be changed by software built in the microprocessor 241 of the power supply. The spray interval may be controlled such that it increases from the set point as the temperature rises and decreases from the set point as the temperature drops. The increase and decrease of the spray interval is preferably in accordance with a predetermined index determined by the characteristics of the liquid to be sprayed. For convenience, the compensation change amount of the spray interval may be limited so that it changes only the spray interval with 0 to 60° C. (e.g. 10 to 45° C.). An extreme temperature recorded by the temperature detection element is therefore regarded as an error and is not taken into account, and an acceptable spray interval is set for a high and low temperatures, though not optimal.

As shown in FIG. 1, the feedback information 25 includes a measurement result of a temperature sensor 251, a measurement result of a humidity sensor 252, a measurement result of a pressure sensor 253, information 254 on the liquid content (for example, information indicating a result of measurement of a liquid accumulation using a level meter), and a measurement result of a voltage/current sensor 255. In addition, the information 254 on the liquid content may include information indicating the viscosity of the liquid (e.g., information indicating a result of measurement of the viscosity of the liquid using a viscosity sensor (not shown)).

Here, the information indicating at least one of (i) the surrounding environment of the electrostatic spraying device 100 and (ii) the operation state of the power supply 21 that supplies power to the electrostatic spraying device 100 is referred to as operation environment information. As the operation environment information, the feedback information 25 may be used.

As an example, the operation environment information may include information indicating at least one of the air temperature, humidity, and pressure around the electrostatic spraying device 100, and the viscosity of the liquid as information indicating the surrounding environment of the electrostatic spraying device 100. In the present embodiment, an explanation will be given with an example of a case in which information indicating the surrounding environment of the electrostatic spraying device 100 includes information (temperature information) indicating the air temperature of the surrounding of the electrostatic spraying device 100. It is to be noted that a case in which the operation environment information includes information indicating the operation state of the power supply 21 (e.g., a measurement result of the voltage/current sensor 255) will be described later.

The above-described operation environment information is stored in an internal memory of the control circuit 24, for example. The control circuit 24 may include an internal memory such as a flash memory, for example. The control circuit 24 executes various types of output power controls to be described later with reference to operation environment information stored in the internal memory, for example. Normally, the control circuit 24 outputs a PWM signal to the oscillator 221 from an output port of the microprocessor 241. The spray duty cycle and spray interval may also be controlled via the same PWM output port. While the electrostatic spraying device 100 sprays the liquid, the PWM signal is output to the oscillator 221.

The control circuit 24 may be capable of controlling the output voltage of the high-voltage generation device 22 by controlling the magnitude, frequency, or duty cycle of the alternating current in the oscillator 221, or ON/OFF time (or a combination thereof) of the voltage.

Regarding Typical Feedback Control

Next, the feedback control used in the typical electrostatic spraying device and its problems will be described. Then, the electrostatic spraying device 100 according to the present embodiment for solving the problem will be described.

Typical Electrostatic Spraying Device

Figure 4:
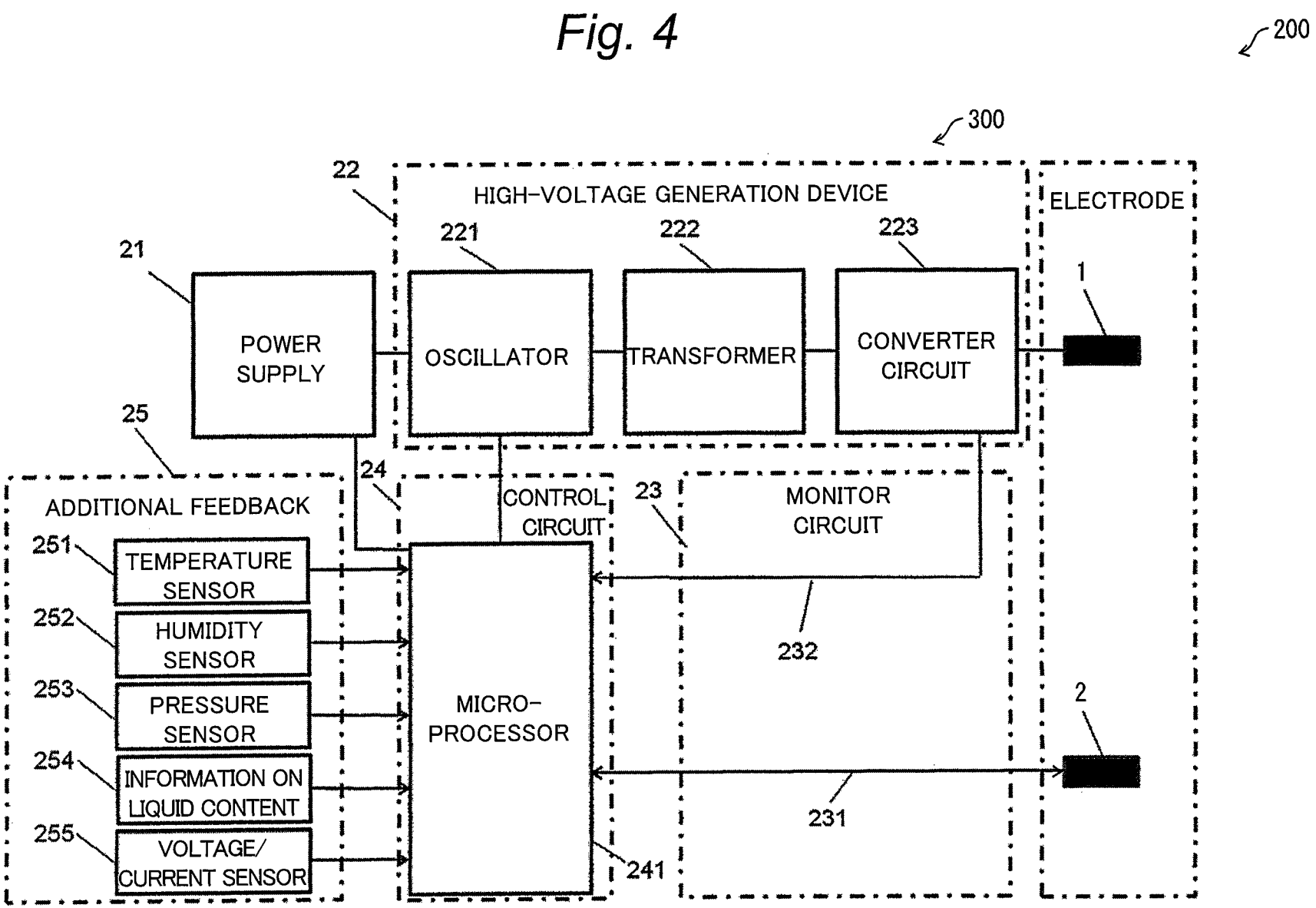
FIG. 4 is a configuration diagram of a typical electrostatic spraying device.

A typical electrostatic spraying device 200 that uses a typical feedback control and a power supply device 300 will be described with reference to FIG. 4. FIG. 4 is a configuration diagram of the typical electrostatic spraying device 200. It is to be noted that in the following, only the differences from the power supply device 3 of FIG. 1 will be described.

The electrostatic spraying device 200 uses a current feedback control for maintaining the current value of the reference electrode 2 at a constant value. The electrostatic spraying device 200 includes the power supply device 300, and the power supply device 300 includes the power supply 21, the high-voltage generation device 22, the control circuit 24, and a monitor circuit 23.

The monitor circuit 23 includes a current feedback circuit 231 and a voltage feedback circuit 232.

The current feedback circuit 231 measures the current value of the reference electrode 2. Since in the electrostatic spraying device 200 the charge is balanced, it is possible to accurately monitor the current value at the spray electrode 1 by measuring and referring to the current value of the reference electrode 2. The current feedback circuit 231 may include any typical current measurement device such as a current transformer.

Information on the current value of the reference electrode 2 is output from the current feedback circuit 231 to the control circuit 24. The control circuit 24 changes the duty cycle of the PWM signal so that the current value of the reference electrode 2 is maintained at a constant value. Then, the control circuit 24 outputs the changed PWM signal to the oscillator 221.

The monitor circuit 23 may also include the voltage feedback circuit 232, and in this case, it measures the voltage applied to the spray electrode. In general, an applied voltage is directly monitored by measuring the voltage at the junction of two resistors forming the voltage divider connecting the spray electrode 1 and the reference electrode 2. Alternatively, an applied voltage is monitored by measuring the voltage generated at a node in the Cockroft-Walton circuit using a similar voltage divider principle. Similarly, for current feedback, the feedback information is processed via an A/D converter or by comparing the feedback signal with a reference voltage value using a comparator.

As described above, the typical electrostatic spraying device 200 uses the current feedback control for maintaining the current value of the reference electrode 2 at a constant value. The feedback control may be a voltage feedback control or the like, and various feedback controls will be described below. In addition, the problems of each feedback control will also be explained.

Various Feedback Controls and Problems Thereof

The feedback control includes a current feedback control, a voltage feedback control, a current/voltage feedback control, and an output power feedback control. Each of the feedback controls will be described below.

The current feedback control is a control for maintaining the current value of the reference electrode at a constant value and has an advantage that the power consumption is small. On the other hand, it is difficult for the current feedback control to generate an electric field suitable for spraying a liquid between the spray electrode 1 and the reference electrode 2 in cases where the resistance value of the spray electrode 1 is lower than a certain value. Such cases include a case in which a leakage current is generated between the spray electrode 1 and the reference electrode 2. This will be described with reference to FIG. 5.

Figure 5:
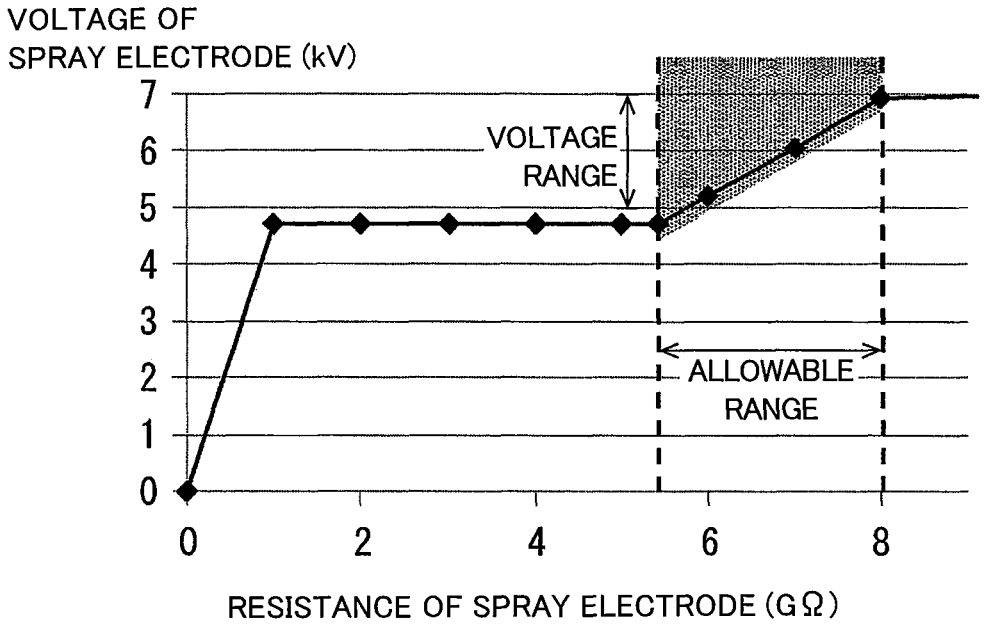
FIG. 5 is a graph showing the relationship between the resistance value of the spray electrode and the voltage value of the spray electrode based on current feedback control.

FIG. 5 is a graph showing an example of the relationship between the resistance value of the spray electrode 1 and the voltage value of the spray electrode 1 based on the current feedback control.

As shown in the figure, the voltage of the spray electrode 1 is in a voltage range suitable for spraying a liquid when a voltage of substantially within 4.8 kV to 6.4 kV is applied between the spray electrode 1 and the reference electrode 2 with the resistance value of the spray electrode 1 within 5.5 GΩ to 8.0 GΩ. That is, when the resistance value of the spray electrode 1 is 5.5 GΩ or more and 8.0 GΩ or less, an electric field suitable for spraying a liquid is generated between the spray electrode 1 and the reference electrode 2. In other words, for the electrostatic spraying device, it can be said that the resistance value between 5.5 GΩ and 8.0 GΩ of the spray electrode 1 is an allowable range for performing the normal operation.

However, when the resistance value of the spray electrode 1 becomes lower than a certain value (5.5 GΩ in FIG. 5) due to a leakage current occurring between the spray electrode 1 and the reference electrode 2, an electric field suitable for spraying the liquid is not generated between the spray electrode 1 and the reference electrode 2. In general natural environments, humidity rises as the air temperature rises. When the humidity rises, due to the influence of moisture in the air, a leakage current tends to be generated due to the influence of the charges charged around the spray electrode 1.

As described above, the current feedback control has a problem that an electric field suitable for spraying becomes difficult to occur in a case where the resistance value of the spray electrode 1 is lower than a certain value.

Furthermore, the current feedback control requires a current feedback control circuit, and the current feedback control circuit requires a configuration to prevent electrostatic discharge and overvoltage. In other words, the current feedback control also has a problem that the circuit structure becomes complicated and the manufacturing cost increases.

It is to be noted that there is an idea of a control in which the current feedback control is switched to the voltage feedback control (described later) in order to generate a suitable electric field between the spray electrode 1 and the reference electrode 2 in a case where the resistance value of the spray electrode 1 becomes lower than 5.5 GΩ.

Next, in the voltage feedback control, it is necessary to increase the output voltage in order to give good spray results in various operation environments. Therefore, the voltage feedback control has a problem that the current consumption increases. In addition, since the voltage feedback control requires a voltage feedback control circuit, there is a problem that the circuit structure becomes complicated and the manufacturing cost increases.

In the current/voltage feedback control, the allowable range of the resistance value of the spray electrode 1 can be widened. On the other hand, the current/voltage feedback control requires a current feedback control circuit and a voltage feedback control circuit, so that there is a problem that the circuit structure becomes complicated and the manufacturing cost increases.

The output power feedback control is a control method of maintaining the electric power (output electric power) which is the product of the current value and the voltage value in the spray electrode 1 at a constant value. The output power feedback control has the lower power efficiency and the narrower allowable range of the resistance value of the spray electrode 1 as compared with the current/voltage feedback control. This is because the output power falls below the level at which electrostatic spraying is performed when the resistance value of the spray electrode 1 falls below a certain value.

The above-described four feedback controls show good spraying results when the resistance value of the spray electrode 1 is within the allowable range (between 5.5 GΩ and 8.0 GΩ in FIG. 5). Among them, it can be said that the current feedback control is optimal in terms of cost and power consumption. This will be described with reference to FIG. 6.

Figure 6:
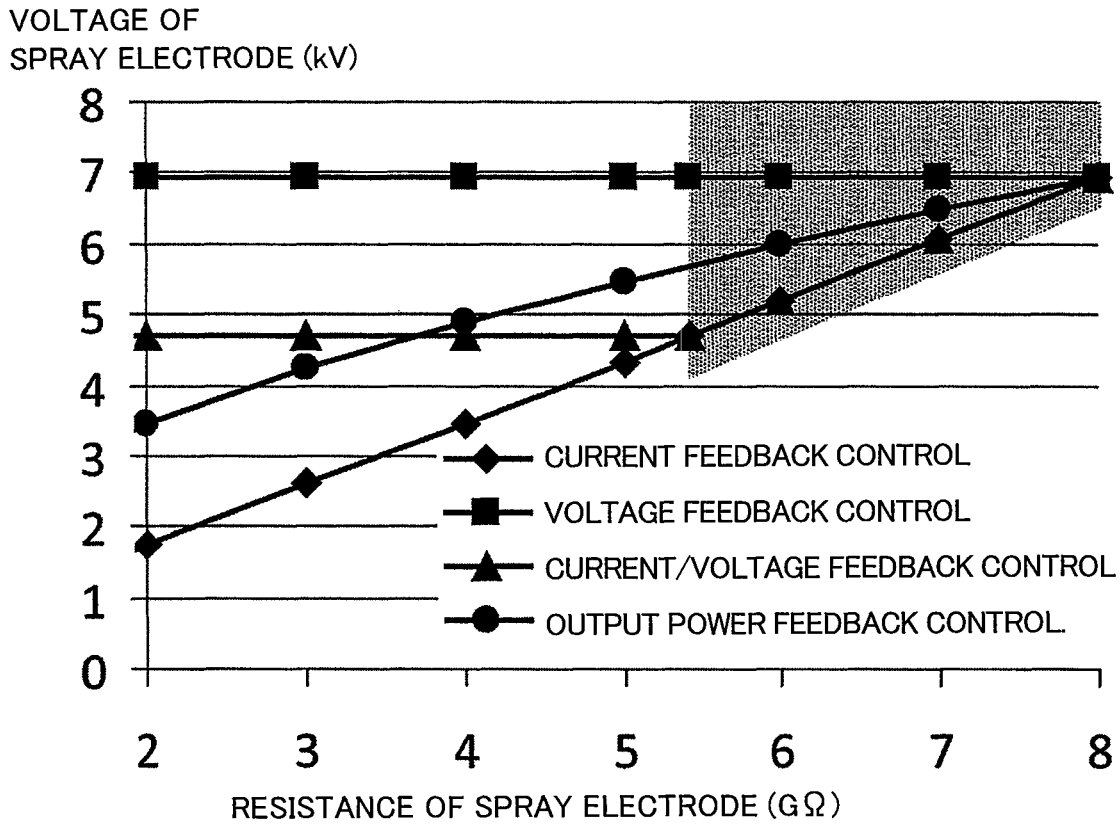
FIG. 6 is a graph showing the relationship between the resistance value of the spray electrode and the voltage value at the spray electrode for each of the current feedback control, the voltage feedback control, the current/voltage feedback control, and the output power feedback control.

FIG. 6 is a graph showing the relationship between the resistance value of the spray electrode 1 and the voltage value at the spray electrode 1 for each of the current feedback control, the voltage feedback control, the current/voltage feedback control, and the output power feedback control. The hatched area in the figure indicates the range corresponding to the voltage range and the allowable range (between 5.5 GΩ and 8.0 GΩ) of the resistance value of the spray electrode 1.

As shown in FIG. 6, when the resistance value of the spray electrode 1 is 5.5 GΩ or more and 8.0 GΩ or less, the voltage value of the spray electrode 1 becomes lowest in a case where the current feedback control is used. Thus, the current feedback control is optimal from the viewpoint of power consumption. On the other hand, in a case where the voltage feedback control is used, the voltage value of the spray electrode 1 becomes highest, and the power consumption increases as compared with the current feedback control.

As described above, when the resistance value of the spray electrode 1 is within the allowable range, the current feedback control is optimal.

However, the current feedback control has a problem that an electric field suitable for electrostatic spraying is not generated between the spray electrode 1 and the reference electrode 2 when the resistance value of the spray electrode 1 is lower than the allowable range. In order to solve this problem, the inventor has found a control method called output power control. Hereinafter, the output power control will be described.

Output Power Control

As shown in FIG. 1, in the electrostatic spraying device 100, the control circuit 24 outputs a PWM signal set to a constant value to the oscillator 221 of the high-voltage generation device 22 based on the above-described operation environment information. As a result, in the electrostatic spraying device 100, the output power of the high-voltage generation device 22 (more specifically, the power to be supplied from the high-voltage generation device 22 to the spray electrode 1) becomes constant.

Hereinafter, the control method of the electrostatic spraying device 100 is referred to as the output power control. In the output power control, the output power of the high-voltage generation device 22 is controlled based on the above-described operation environment information independently of the current value and the voltage value in the spray electrode 1 and the reference electrode 2.

That is, in terms of the technical idea, the output power control differs from the output power feedback control, in which the output power is controlled to be constant by carrying out a feedback control on the product of the current value and the voltage value in the spray electrode 1.

Figure 7:
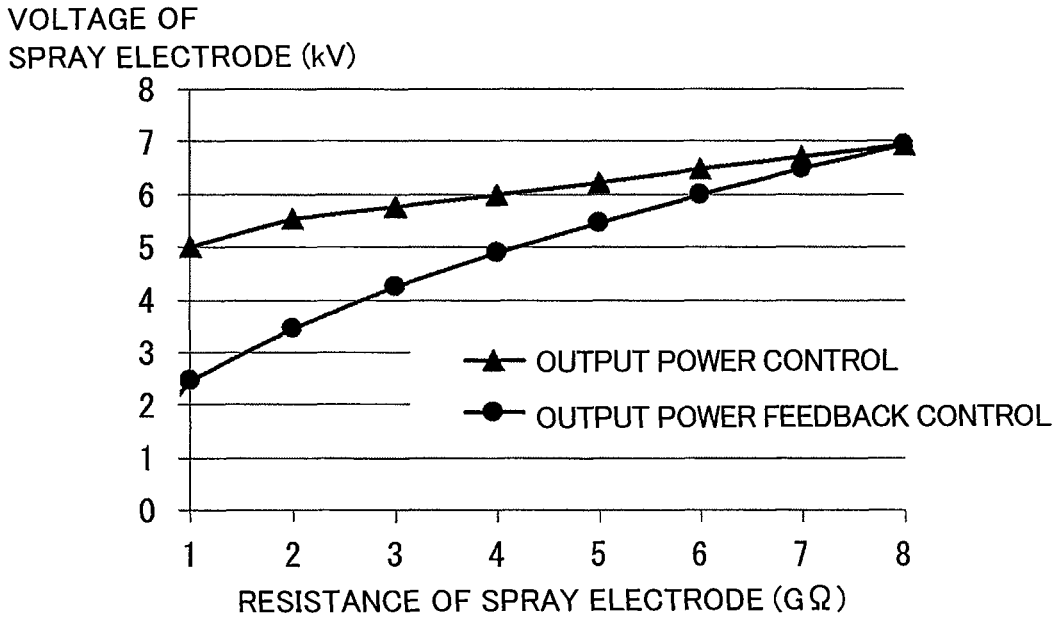
FIG. 7 is a graph showing the relationship between the resistance value of the spray electrode and the voltage of the spray electrode in the case of the output power control and the output power feedback control.

Here, FIG. 7 is a graph showing the relationship between the resistance value of the spray electrode and the voltage of the spray electrode in the case of the output power control and the output power feedback control. As shown in the figure, the voltage values of the spray electrode 1 at the maximum resistance value (8 GΩ in FIG. 6) of the spray electrode 1 by the output power control and the output power feedback control both become about 7 kV, when the set value of the output power feedback control is properly set.

However, when the resistance value of the spray electrode 1 is lower than 8 GΩ, the output voltage at the spray electrode 1 by the output power control becomes higher than the output voltage by the output power feedback control. This means that the electrostatic spraying performance of the output power control becomes higher than the electrostatic spraying performance of the output power feedback control in a range where the resistance value of the spray electrode 1 is lower than 0.8 GΩ.

Furthermore, the output power control has no requirement of the need for a feedback circuit, simplifies the circuit structure, and significantly reduces the manufacturing cost of the electrostatic spraying device 100.

Figure 8:
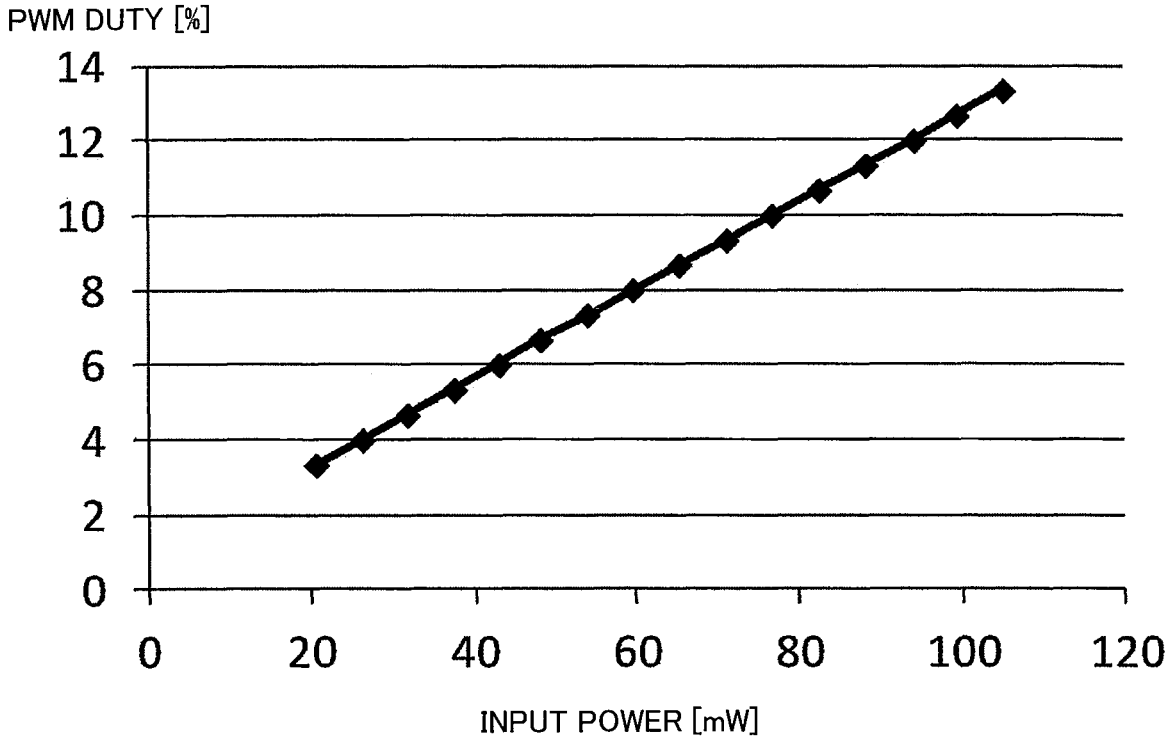
FIG. 8 is a graph showing the relationship between the input power from the power supply to the high-voltage generation device and the duty cycle of a PWM signal.

FIG. 8 is a graph showing the relationship between the input power from the power supply 21 to the high-voltage generation device 22 and the duty cycle of the PWM signal. For obtaining the graph of FIG. 8, first, the set value of the duty cycle of the PWM signal is changed in several patterns. Then, the current consumption of the battery corresponding to the changed setting value is measured. Next, the input power from the power supply 21 to the high-voltage generation device 22 is calculated from (current consumption)× (battery voltage), and the input power is plotted against the duty cycle of the PWM signal.

As shown in the figure, the input power and the duty cycle of the PWM signal are in a proportional relationship. This indicates that controlling the output power of the high-voltage generation device 22 is possible through the setting of the duty cycle of the PWM signal. This is because the output power of the high-voltage generation device 22 varies according to the above-described input power. It is to be noted that from the viewpoint of controlling the input power to the high-voltage generation device 22, the output power control of the present embodiment may be referred to as input power control.

Figure 9:
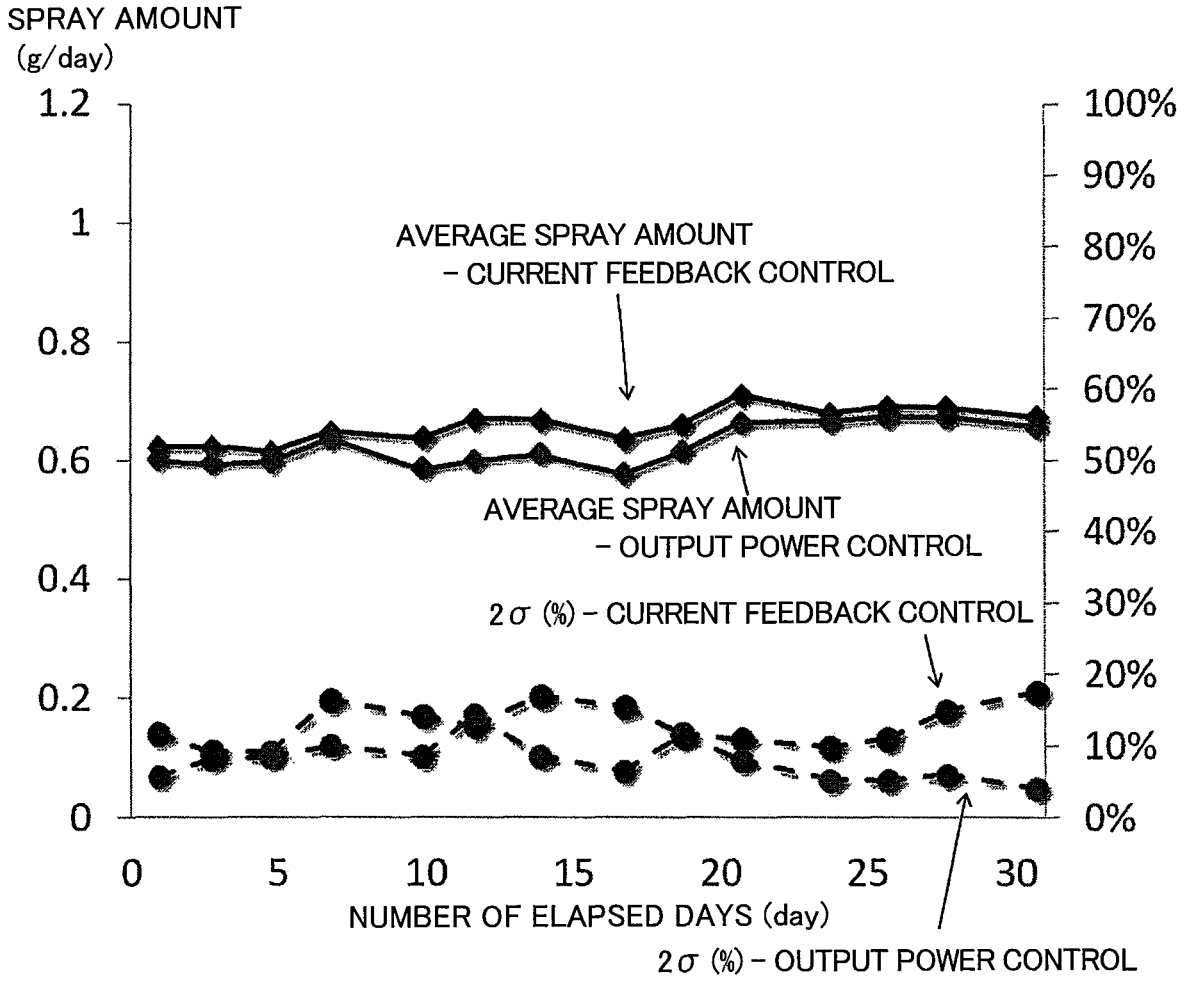
FIG. 9 is a diagram showing the relationship between the number of elapsed days and the spray amount of each of the current feedback control and the output power control.

Next, it is confirmed with FIG. 9 whether or not a significant difference is observed in the spray amount between the current feedback control and the output power control. FIG. 9 is a diagram showing the relationship between the number of elapsed days and the spray amount of each of the current feedback control and the output power control.

The actual duty cycle is determined by observing the state of spray. In FIG. 9, the duty cycle is set to 6.7% in order to obtain a sufficiently high voltage value in the spray electrode 1 irrespective of the resistance value of the spray electrode 1. At this time, the PWM period is 1.2 ms and the ON time is 80 μs.

As shown in the figure, both the current feedback control and the output power control transition, maintaining the spray amount of about 0.6 g/day irrespectively of the number of days elapsed. In addition, in the both controls, 2σ, which is double the standard deviation (σ), transitions around 10% regardless of the number of days elapsed. That is, a significant difference is not observed in the current feedback control and the output power control in terms of the spray amount and its stability.

Figure 10:
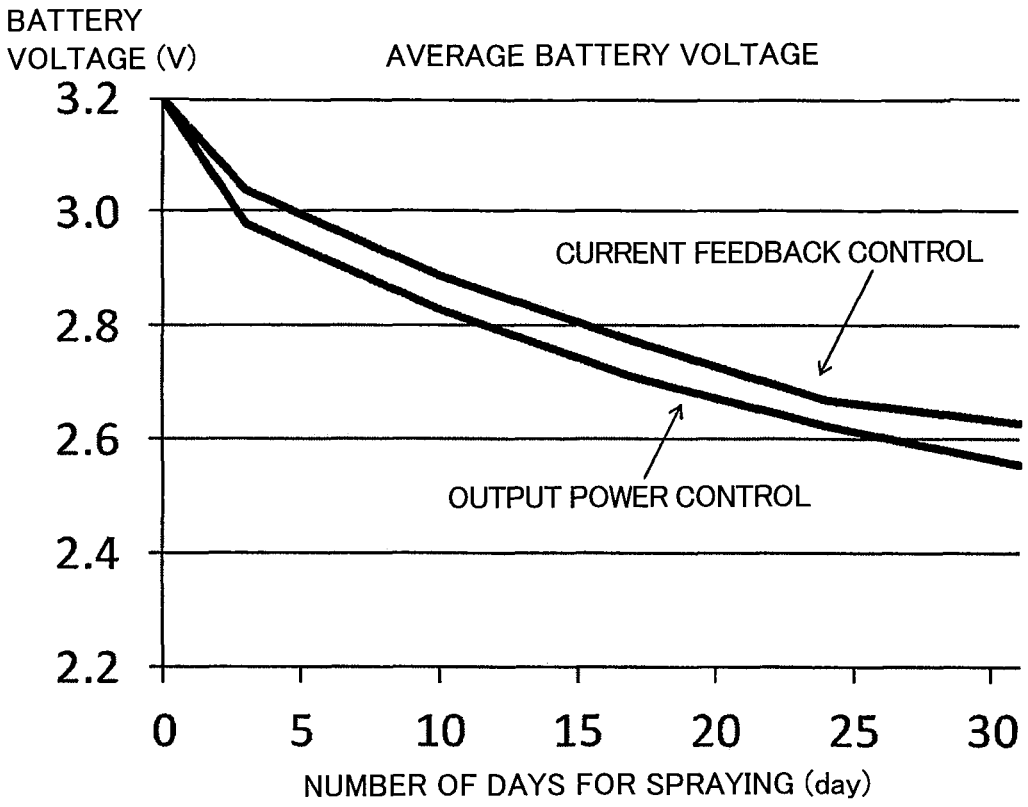
FIG. 10 is a diagram showing the relationship between the number of elapsed days and the battery voltage of each of the current feedback control and the output power control.

FIG. 10 is a diagram showing the relationship between the number of elapsed days and the battery voltage of each of the current feedback control and the output power control.

As shown in the figure, the battery voltage of the current feedback control is higher than the battery voltage of the output power control. This indicates that the power consumption of the output power control is higher. However, additionally noted that even in the case of output power control, the spray performance falls within the allowable range during use for one month using two AA batteries.

Figure 11:
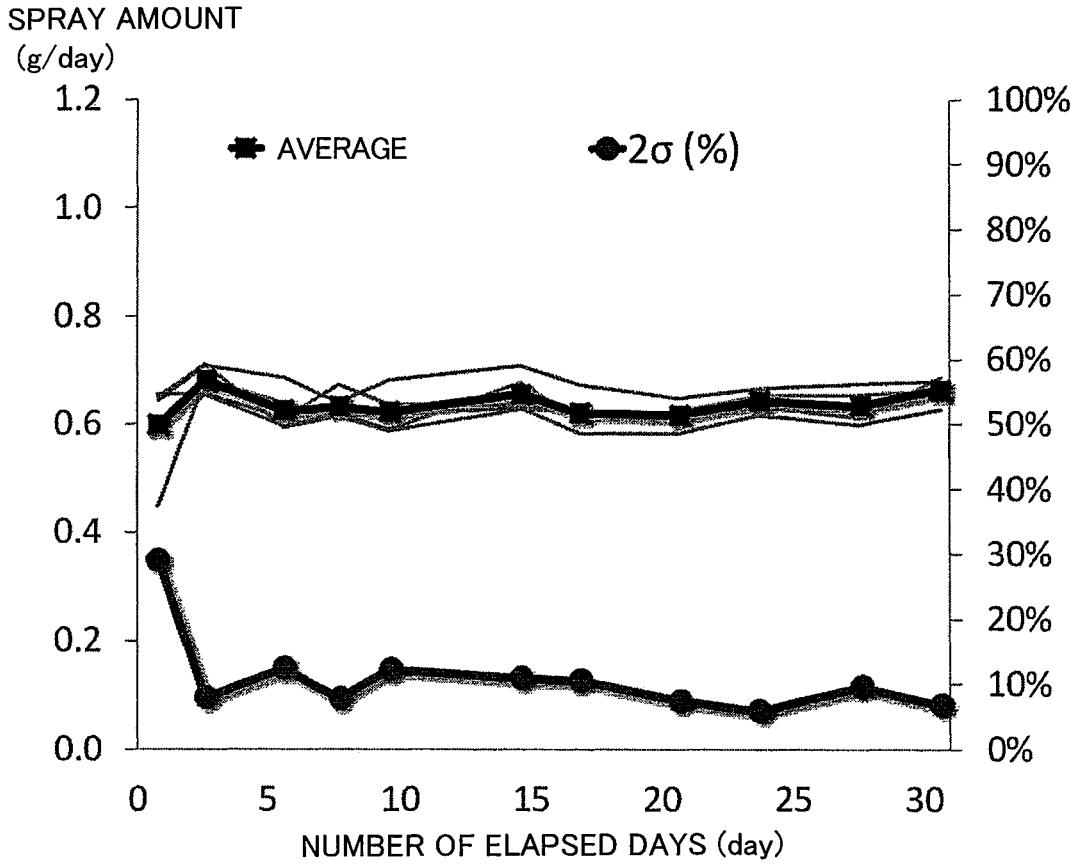
FIG. 11 is a diagram showing the relationship between the number of elapsed days and the spray amount at the air temperature of 15° C. and the relative humidity of 35%.
Figure 12:
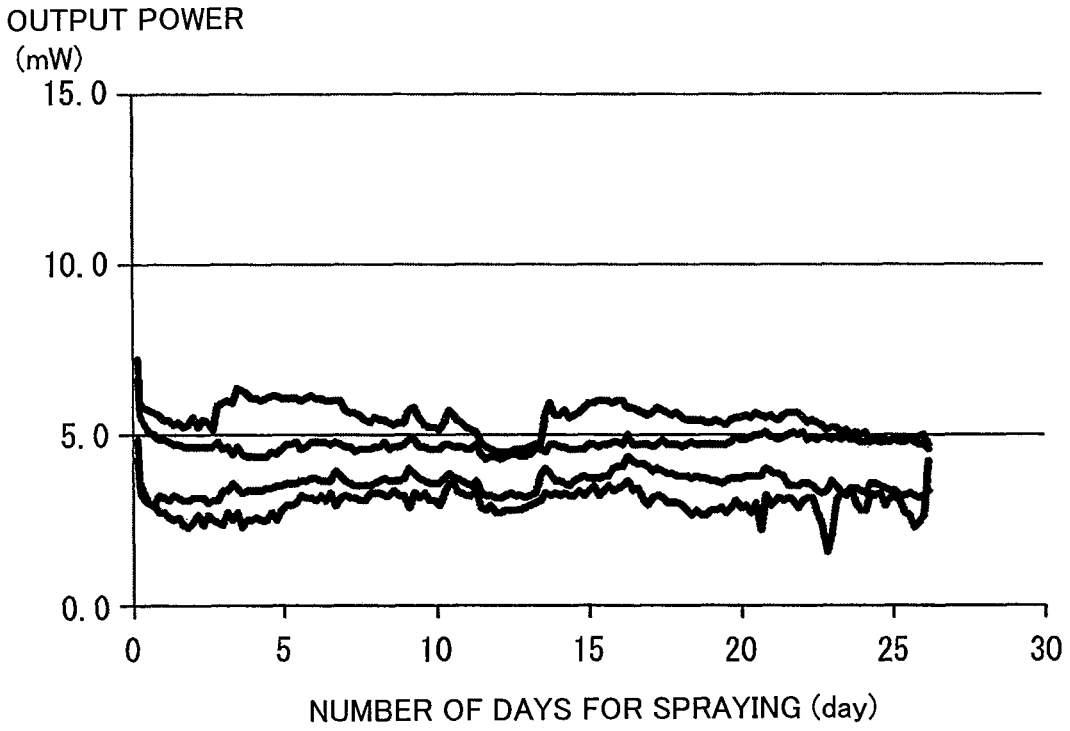
FIG. 12 is a diagram showing the relationship between the number of days for spraying and the output power at the air temperature of 15° C. and the relative humidity of 35%.
Figure 13:
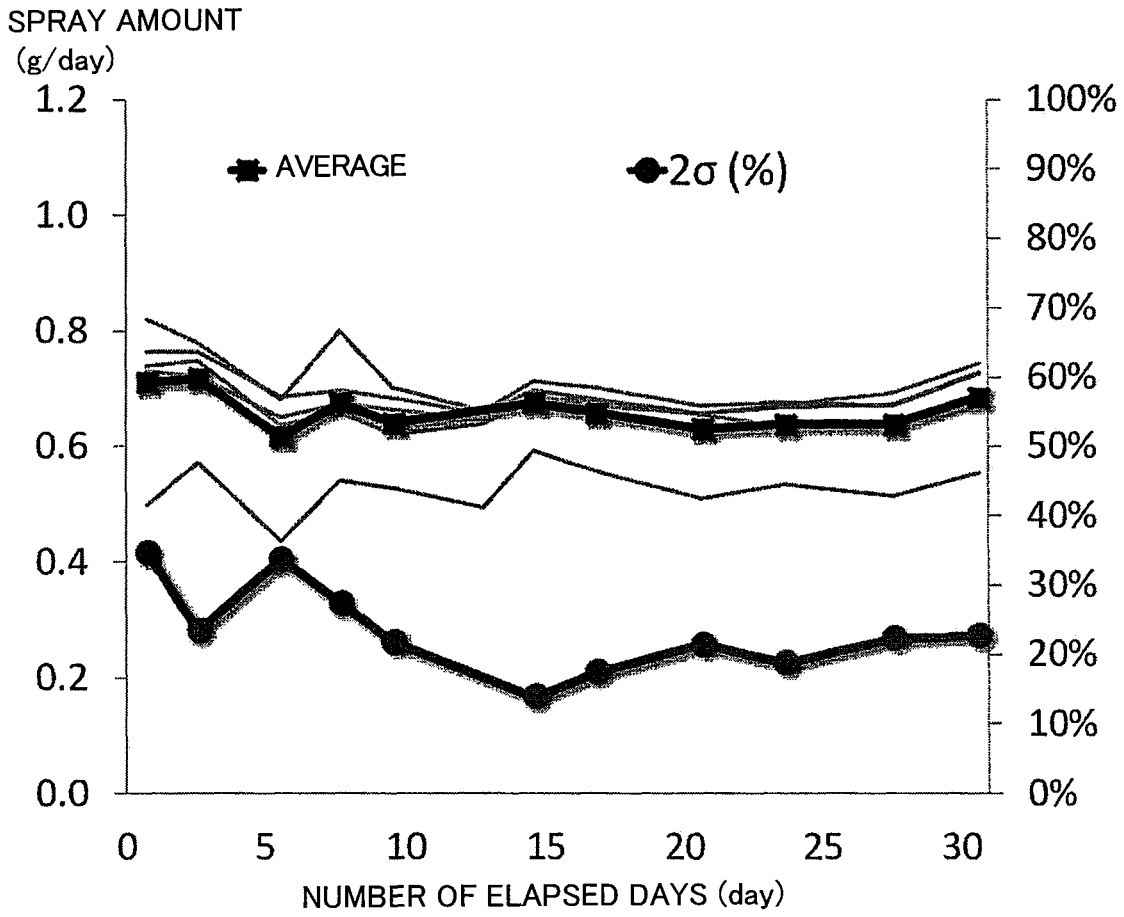
FIG. 13 is a diagram showing the relationship between the number of elapsed days and the spray amount at the air temperature of 25° C. and the relative humidity of 35%.
Figure 14:
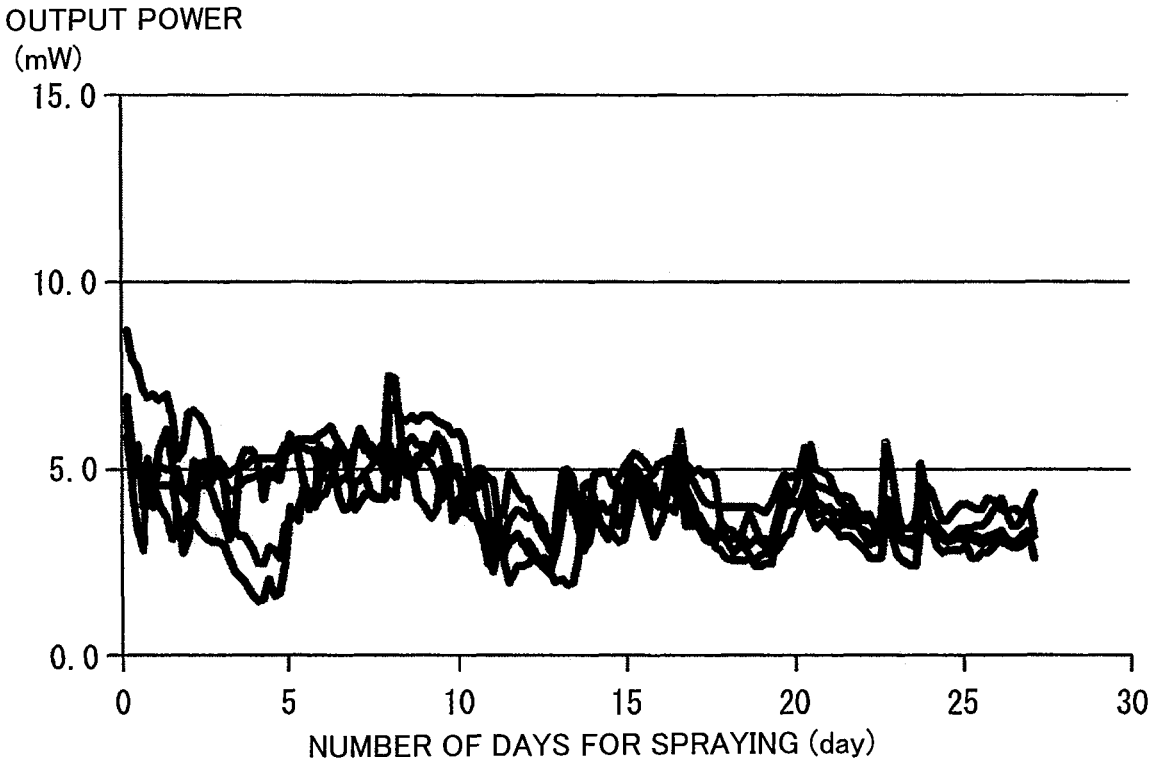
FIG. 14 is a diagram showing the relationship between the number of days for spraying and the output power at the air temperature of 25° C. and the relative humidity of 35%.
Figure 15:
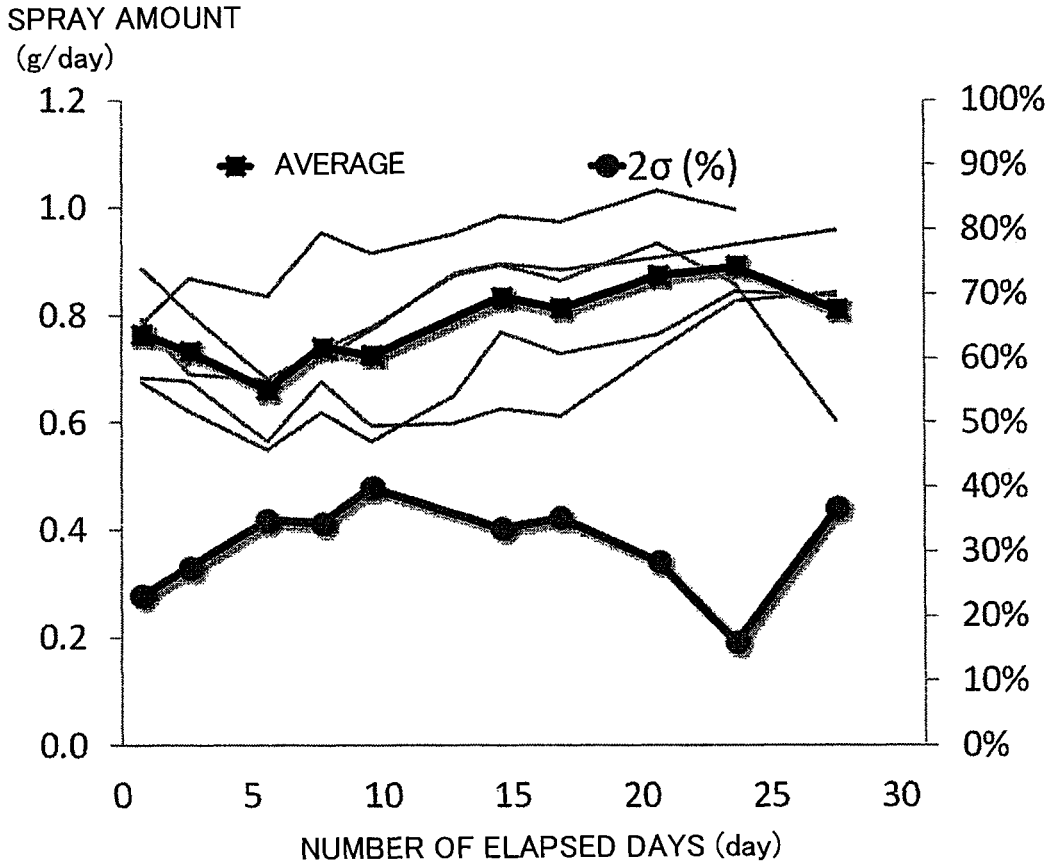
FIG. 15 is a diagram showing the relationship between the number of elapsed days and the spray amount at the air temperature of 35° C. and the relative humidity of 75%.

Next, the results of electrostatic spraying using the output power control under different conditions will be described with reference to FIGS. 11 to 16. Here, the different conditions are (1) air temperature of 15° C. and relative humidity of 35%, (2) air temperature of 25° C. and relative humidity of 55%, and (3) air temperature of 35° C. and relative humidity of 75%. FIGS. 11, 13, and 15 are each graphs of the average values when spraying is performed 10 times and the doubled values of the standard deviation (σ).

FIG. 11 is a diagram showing the relationship between the number of elapsed days and the spray amount at the air temperature of 15° C. and the relative humidity of 35%. FIG. 12 is a diagram showing the relationship between the number of days for spraying and the output power at the air temperature of 15° C. and the relative humidity of 35%.

FIG. 13 is a diagram showing the relationship between the number of elapsed days and the spray amount at the air temperature of 25° C. and the relative humidity of 35%. FIG. 14 is a diagram showing the relationship between the number of days for spraying and the output power at the air temperature of 25° C. and the relative humidity of 35%.

Figure 16:
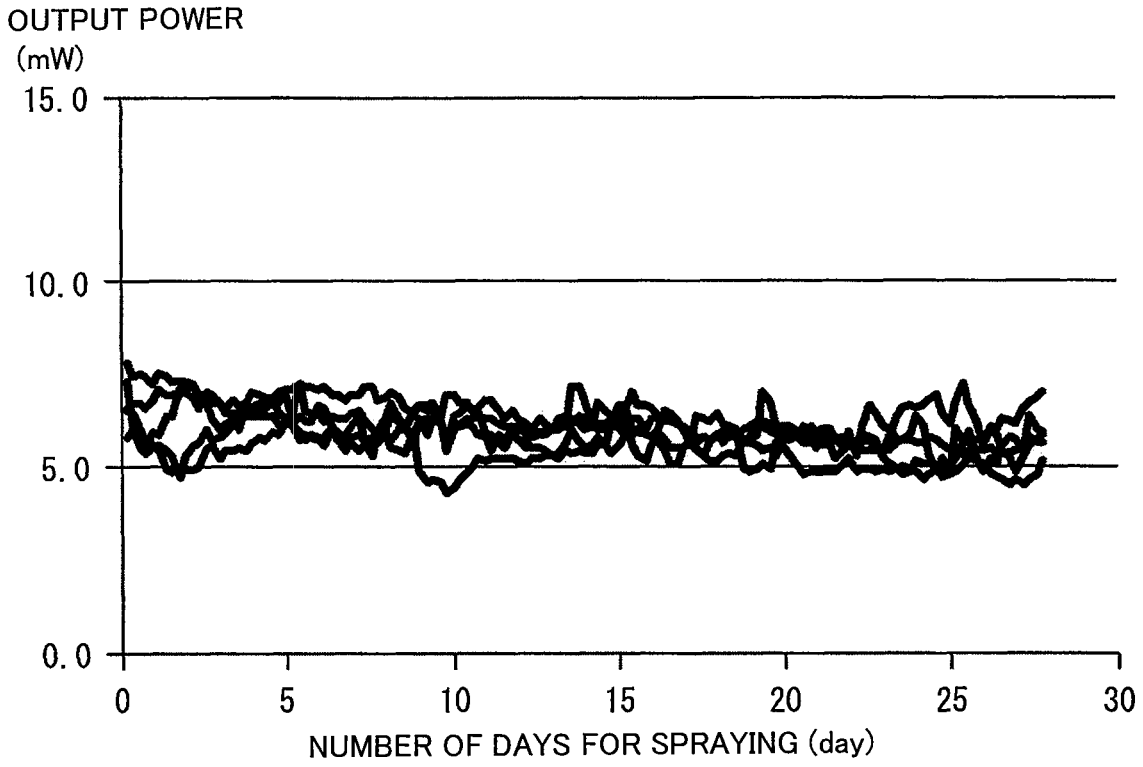
FIG. 16 is a diagram showing the relationship between the number of days for spraying and the output power at the air temperature of 35° C. and the relative humidity of 75%.

FIG. 15 is a diagram showing the relationship between the number of elapsed days and the spray amount at the air temperature of 35° C. and the relative humidity of 75%. FIG. 16 is a diagram showing the relationship between the number of days for spraying and the output power at the air temperature of 35° C. and the relative humidity of 75%.

As shown in FIGS. 11, 13, and 15, the average spray amount is maintained at 0.6 g/day or more under any conditions. This indicates that the output power control can spray a desired amount of liquid under various conditions. It is to be noted that the double value of the standard deviation (σ) became unstable due to a large fluctuation as the temperature and humidity were higher.

As shown in FIGS. 12, 14, and 16, under any conditions, the output power was maintained at around 5.0 mW and a sufficiently high voltage value was obtained at the spray electrode 1. It is to be noted that as the temperature and humidity increased, the output power stably exceeded 5.0 m.

Setting of Duty Cycle

Figure 17:
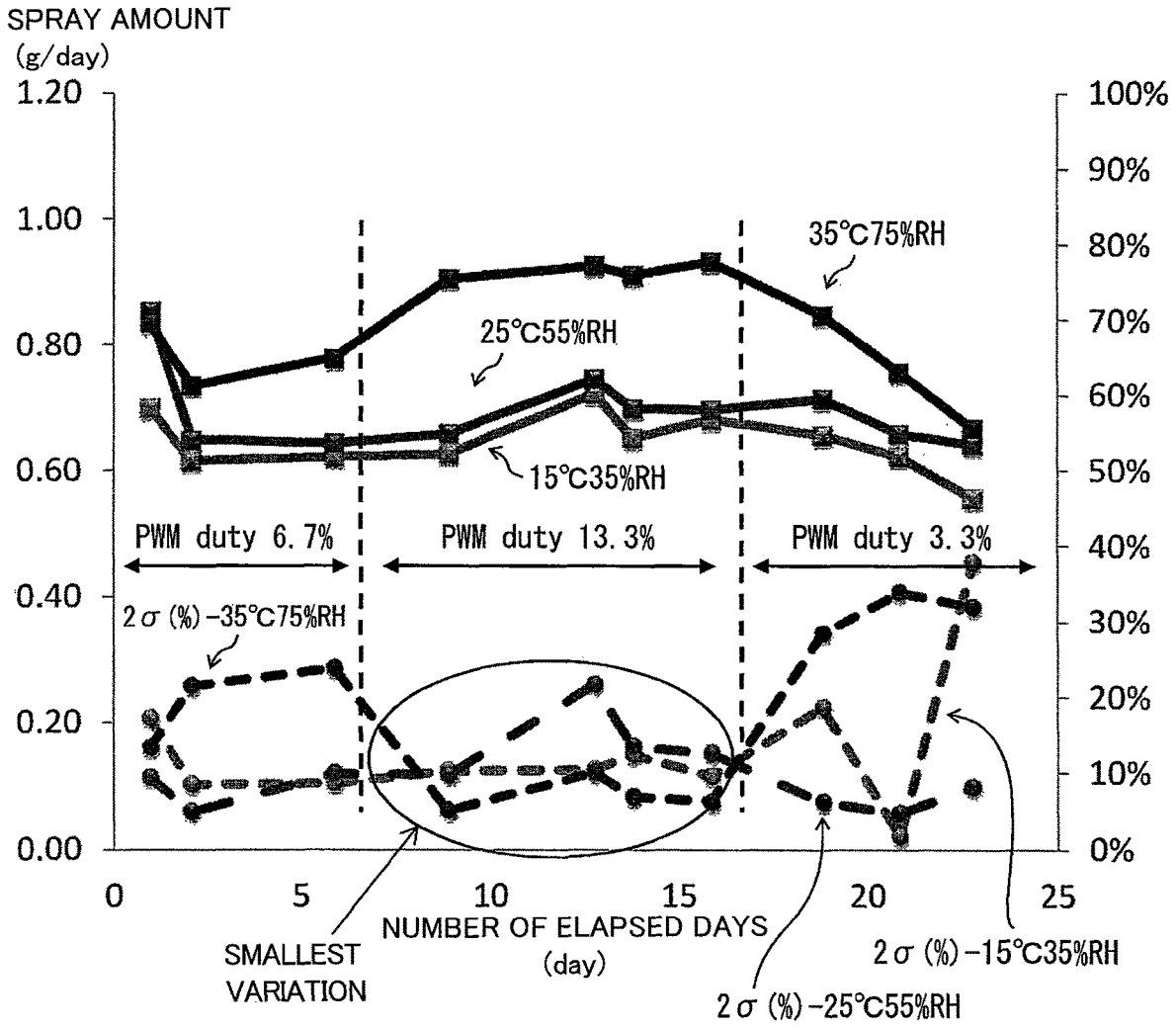
FIG. 17 is a graph showing the relationship between the number of elapsed days and the spray amount at the air temperature of 15° C. and the relative humidity of 35%, the air temperature of 25° C. and the relative humidity of 55%, and the air temperature of 35° C. and the relative humidity of 75% when the duty cycle are changed to 6.7%, 13.3%, and 3.3%.

Next, an optimum duty cycle under different conditions will be described with reference to FIG. 17. FIG. 17 is a graph showing the relationship between the number of elapsed days and the spray amount at the air temperature of 15° C. and the relative humidity of 35%, the air temperature of 25° C. and the relative humidity of 55%, and the air temperature of 35° C. and the relative humidity of 75% when the duty cycle are changed to 6.7%, 13.3%, and 3.3%.

At the time of acquiring this data, the output voltage and the current value were measured at the spray electrode 1, and the result was recorded by the power supply device 3. The output power is acquired as the product of the output voltage and the current value in the spray electrode 1. The output power is the total amount of electric power consumed by the electrostatic spraying, more specifically, the total value of the electric power required for positively charging the droplet and the electric power required for generating the negatively charged ion flow.

According to a result of the above data acquisition, the output power becomes high under high humidity. This is considered as an influence of the charge which is charged in the dielectric around the spray electrode 1. Also, in order to enhance the spray characteristics under high humidity, it is preferable to increase the output power. This is to generate a sufficient ion flow by strengthening the electric field around the spray electrode 1.

Comparing the spray results under the three conditions, the spray characteristics under a high humidity of the air temperature of 35° C. and the relative humidity of 75% change most complicatedly. As a factor of this, an influence by the electric charges charged in the dielectric around the spray electrode 1 is conceivable. On the other hand, the spray characteristics at the air temperature of 15° C. and the relative humidity of 35% and the air temperature of 25° C. and the relative humidity of 55% do not change so much and are stable.

Next, the results of spraying when the duty cycle is varied to 6.7%, 13.3%, and 3.3% will be described.

The duty cycle was set to 6.7% (PWM period of 1.2 ms and ON time of 80 μs) for the first six days after the start of the test. Subsequently, the duty cycle was set to 13.3% (PWM period of 1.2 ms and ON time of 160 μs) from the sixth day to the 16th day from the start of the test. Furthermore, the duty cycle was set to 3.3% (PWM period of 1.2 ms and ON time of 40 μs) after the 16th day from the start of the test.

The results in FIG. 17 indicate that the stability of spraying becomes the best when the duty cycle is set to 13.3%. The reason is considered that the influence of the electric charges charged on the dielectric around the spray electrode 1 is the smallest. On the other hand, the stability of spraying becomes lowest when the duty cycle is set to 3.3%. This is because the influence of the electric charges charged on the dielectric around the spray electrode 1 becomes largest, and the spray characteristics under a high humidity of the air temperature of 35° C. and the relative humidity of 75% are significantly affected.

This result suggests the following. That is, a desired spray amount can be stably obtained by the output power control even without using the feedback control. At this time, it is possible to further enhance the stability of the spray even under high humidity conditions by setting the duty cycle high and reducing the influence of the electric charges charged on the dielectric around the spray electrode 1.

Compensation Scheme

FIG. 17 presents that the spray fluctuation is suppressed by increasing the set value of the duty cycle of the PWM signal.

Figure 18:
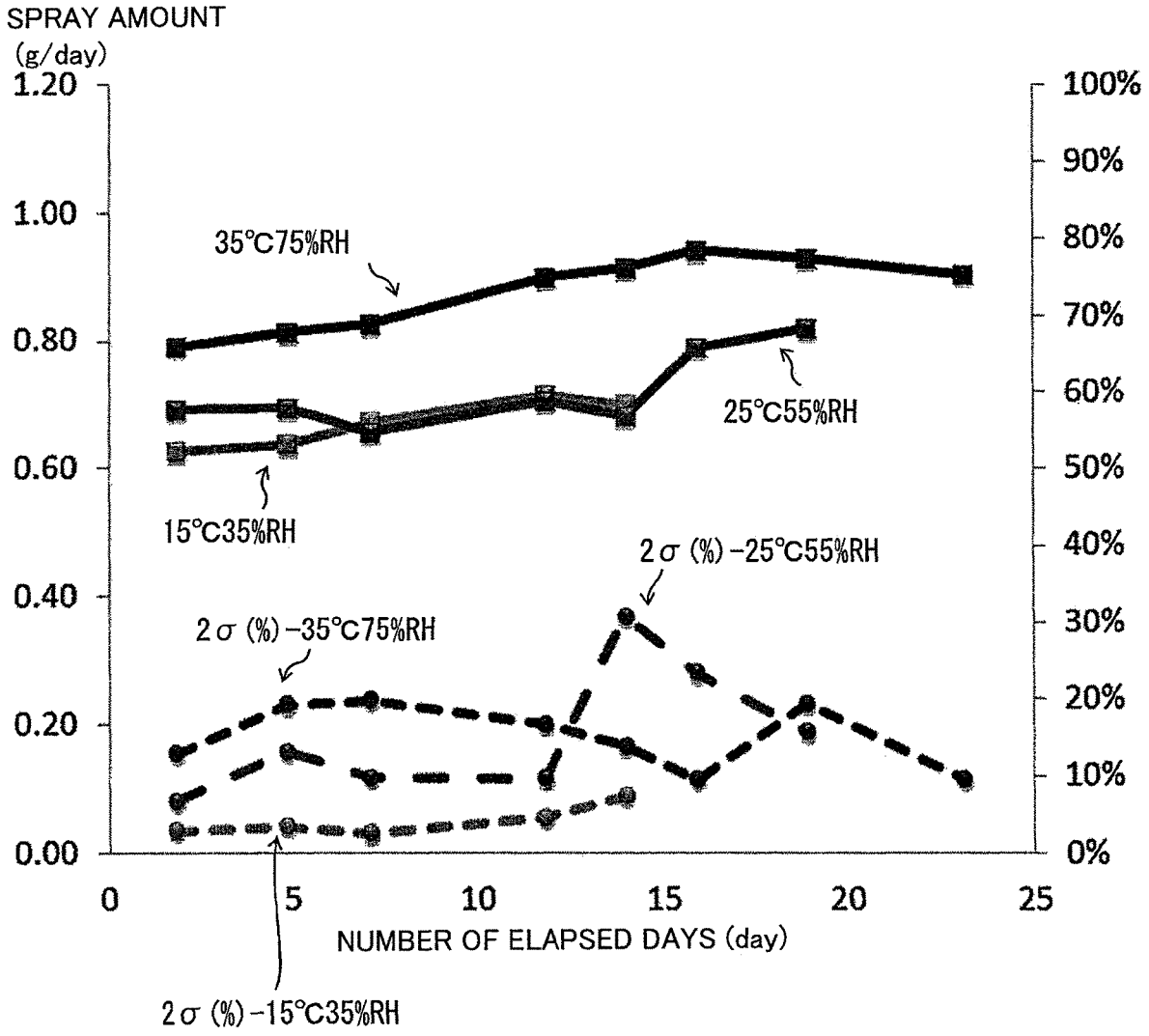
FIG. 18 is a graph showing the relationship between the number of elapsed days and the spray amount at the air temperature of 15° C. and the relative humidity of 35%, the air temperature of 25° C. and the relative humidity of 55%, and the air temperature of 35° C. and the relative humidity of 75% when the duty cycle is set to 13.3%.

However, when the duty cycle of the PWM signal is increased, the current consumption increases. This will be described with reference to FIG. 18. FIG. 18 is a graph showing the relationship between the number of elapsed days and the spray amount at the air temperature of 15° C. and the relative humidity of 35%, the air temperature of 25° C. and the relative humidity of 55%, and the air temperature of 35° C. and the relative humidity of 75% when the duty cycle is set to 13.3%.

As described with reference to FIG. 18, when the duty cycle is set to 13.3%, the state of spray under a high humidity of the air temperature of 35° C. and the relative humidity of 75% is stabilized. Also, when the duty cycle is set to 13.3%, the spray characteristics under humidity conditions of the air temperature of 15° C. and the relative humidity of 35% and of the air temperature of 25° C. and the relative humidity of 55% are also stable.

However, at the air temperature of 15° C. and the relative humidity of 35% as well as the air temperature of 25° C. and the relative humidity of 55%, the high voltage is applied under a low temperature for a long time, and the power consumption of the power supply device 3 is increased. As a result, it is assumed that the continuous operation period with two AA batteries is less than 30 days. FIG. 18 shows the number of days of operation is a little less than 15 under the condition of the air temperature of 15° C. and the relative humidity of 35% and a little less than 20 under the condition of the air temperature of 25° C. and the relative humidity of 55% when the electrostatic spraying device is operated using two AA batteries. Since the amount of electric power stored in advance in the battery is finite, if the number of days of operation is small, the user is required to replace the battery excessively.

Therefore, the inventor examined a compensation scheme for suppressing current consumption even under a low temperature. This compensation scheme has been studied focusing on the point that the duty cycle of the PWM signal is preferably increased under high humidity conditions and the humidity also becomes high as the air temperature is high.

Specifically, the control circuit 24 in the electrostatic spraying device 100 may determine the spray time (spray interval) Sprayperiod(T) based on the following formula (1):

[Math. 3]

$$Sprayperiod(T) = \left(1 + \frac{T - T_0}{100} * \text{Sprayperiod_compensation_rate}\right) * Sprayperiod(T_0) \quad (1)$$

where,

Sprayperiod(T): Spray time (s) for which a period of time during which the electrostatic spraying device 100 sprays the liquid and a period of time during which it stops spraying one cycle at the temperature T T: Air temperature (° C.)

$T_0$: Initial setting temperature (° C.)

Sprayperiod_compensation_rate: Spray time compensation rate (–)

Sprayperiod($T_0$): Spray time (s) for which a period of time during which the electrostatic spraying device 100 sprays the liquid and a period of time during which it stops spraying one cycle at the initial setting temperature $T_0$.

Further, in the electrostatic spraying device 100, the control circuit 24 may determine PWM_ON_time(T), which is the ON time (period of time to turn on the PWM signal) of the PWM signal, may be determined based on the following formula (2):

[Math. 4]

$$\text{PWM_ON_time}(T) = \left(1 + \frac{T - T_0}{100} * \text{PWM_compensation_rate}\right) * \text{PWM_ON_time}(T_0) \quad (2)$$

where,

PWM_ON_time(T): ON time (μs) of PWM signal

PWM_compensation rate: PWM compensation rate (/° C.)

PWM_ON_time($T_0$): ON time (μs) of PWM signal at the initial setting temperature $T_0$ Spray time (s) with a period of time during which spraying is stopped and another time as one cycle.

The above formulae (1) and (2) are formulae showing the compensation scheme and are used when the air temperature T is between 10° C. and 40° C. While FIG. 17 and the like present an example of the case in which the air temperature T is between 15° C. and 35° C., the inventor of the present application have found that the above-mentioned formulae (1) and (2) are applicable also when the air temperature T is (i) between 10° C. and 15° C. and (ii) between 35° C. and 40° C.

The air temperature T may be acquired by the temperature sensor 251 shown in FIG. 1 or may be acquired from an external thermometer. As described above, the operation environment information includes temperature information (information indicating the air temperature T).

The temperature information is transmitted from the temperature sensor 251 or an external thermometer to the microprocessor 241. The microprocessor 241 plugs the temperature information into formulae (1) and (2) to calculate Sprayperiod(T) and PWM_ON_time(T).

The initial setting temperature $T_0$ (° C.), spray time compensation rate (–), and Sprayperiod($T_0$) in formula (1) and the PWM_compensation rate:/° C. and PWM_compensation rate:/° C. in formula (2) may be input in advance in the microprocessor 241. Each value may be stored in the internal memory or the like of the control circuit 24.

For example, in formula (1), let $T_0$=15° C., Sprayperiod_compensation_rate=3.311/° C. Also, let Sprayperiod ($T_0$) be 171.6 (s) at 15° C.

Similarly, in formula (2), let PWM_compensation rate=51° C., for example. Also, let PWM_ON_time($T_0$) be 80 (μs) at 15° C.

The compensation schemes shown in formulae (1) and (2) set the set value of the duty cycle of the PWM signal in response to change in the air temperature. In other words, the set value of the duty cycle of the PWM signal is raised when the air temperature rises, and the set value of the duty cycle of the PWM signal is lowered when the air temperature drops. By using this compensation scheme, a strong electric field can be generated between the spray electrode 1 and the reference electrode 2 even in a case where a leakage current is generated between the spray electrode 1 and the reference electrode 2 with the resistance value of the spray electrode 1 in the range 1 GΩ to 5.5 GΩ. That is, even when the influence of electric charge charged in the dielectric reaches the electric field generated between the spray electrode 1 and the reference electrode 2, the stability of spray can be maintained by using the output power control to output the PWM signal set to a constant value to the oscillator 221 of the high-voltage generation device 22.

It is to be noted that unless the air temperature changes, the set value of the duty cycle of the PWM signal remains unchanged. Therefore, the electrostatic spraying device 100 can also perform output power control for each air temperature by using the set value of the duty cycle of the PWM signal corresponding to the air temperature.

Figure 19:
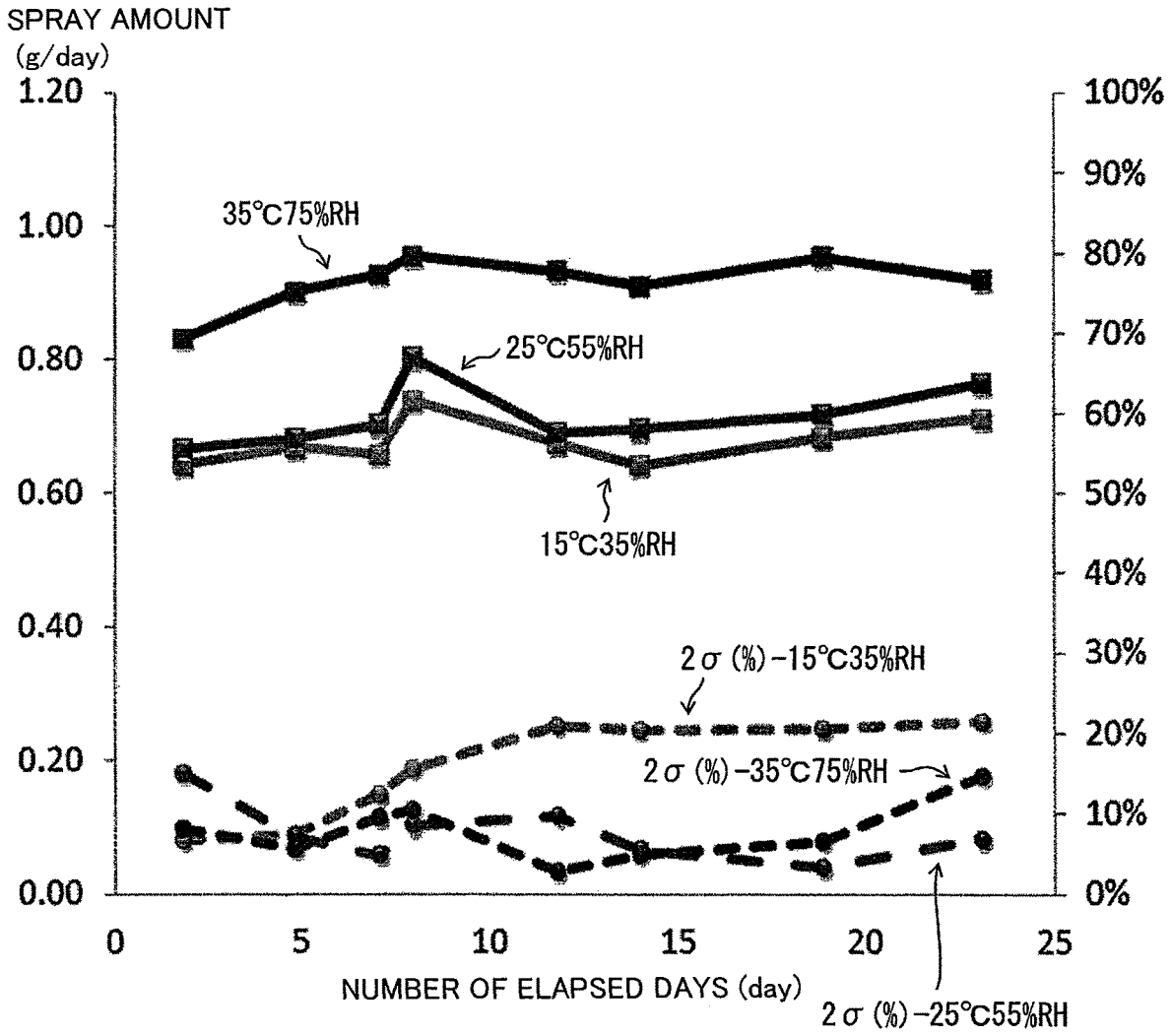
FIG. 19 is a graph showing the relationship between the number of elapsed days and the spray amount at the air temperature of 15° C. and the relative humidity of 35%, the air temperature of 25° C. and the relative humidity of 55%, and the air temperature of 35° C. and the relative humidity of 75% when the duty cycle is set to 13.3% and a compensation scheme is applied.

FIG. 19 is a graph showing the relationship between the number of elapsed days and the spray amount at the air temperature of 15° C. and the relative humidity of 35%, the air temperature of 25° C. and the relative humidity of 55%, and the air temperature of 35° C. and the relative humidity of 75% when the duty cycle is set to 13.3% and a compensation scheme is applied.

As understood from a comparison with FIG. 18, the electrostatic spraying device operates for many days while maintaining a good spray state, in the cases of using two AA batteries in spraying at the air temperature of 15° C. and the relative humidity of 35% and at the air temperature of 25° C. and the relative humidity of 55%. This means that the current consumption in spraying at the air temperature of 15° C. and the relative humidity of 35% and at the air temperature of 25° C. and the relative humidity of 55% has been reduced. It is to be noted that in the data of FIG. 19, in formula (1), $T_0$=15° C., Sprayperiod_compensation_rate=3.311/° C., and Sprayperiod($T_0$) is 171.6 (s) at 15° C. Also, in formula (2), PWM_compensation rate=5/° C., and PWM_ON_time($T_0$) is 80 (μs) at $T_0$=15° C.

Here, the electrostatic spraying device 100 may also combine the following compensation schemes, taking into account the viscosity characteristics of the liquid. Specifically, the viscosity of liquid rises as the air temperature drops, and the viscosity drops as the air temperature rises. Therefore, when the air temperature rises, for example, the control circuit 24 reduces the set value of Sprayperiod(T). As a result, when the air temperature becomes high, the power consumption of the battery is suppressed. On the other hand, when the air temperature rises, for example, the control circuit 24 raises PWM_ON_time. As a result, the higher the air temperature becomes, the higher the power consumption of the battery becomes. With these two factors balanced, a compensation scheme is built for optimizing power consumption over a wide range of air temperature. In addition, with this scheme, the spray amount of liquid is moderately suppressed under high temperature conditions.

In this way, it is also possible to apply the compensation scheme taking into account the viscosity characteristics of the liquid. Similarly, it is also possible to apply a compensation scheme based on information such as the humidity around the electrostatic spraying device 100, the pressure (atmospheric pressure), and the amount of liquid stored in the electrostatic spraying device 100.

Further, the output power control can also be performed by further using information (e.g., information indicating humidity, pressure, and viscosity) other than the temperature information included in the information (one instance of the operation environment information) indicating the surrounding environment of the electrostatic spraying device 100. Alternatively, output power control may be performed using only information other than temperature information.

Figure 20:
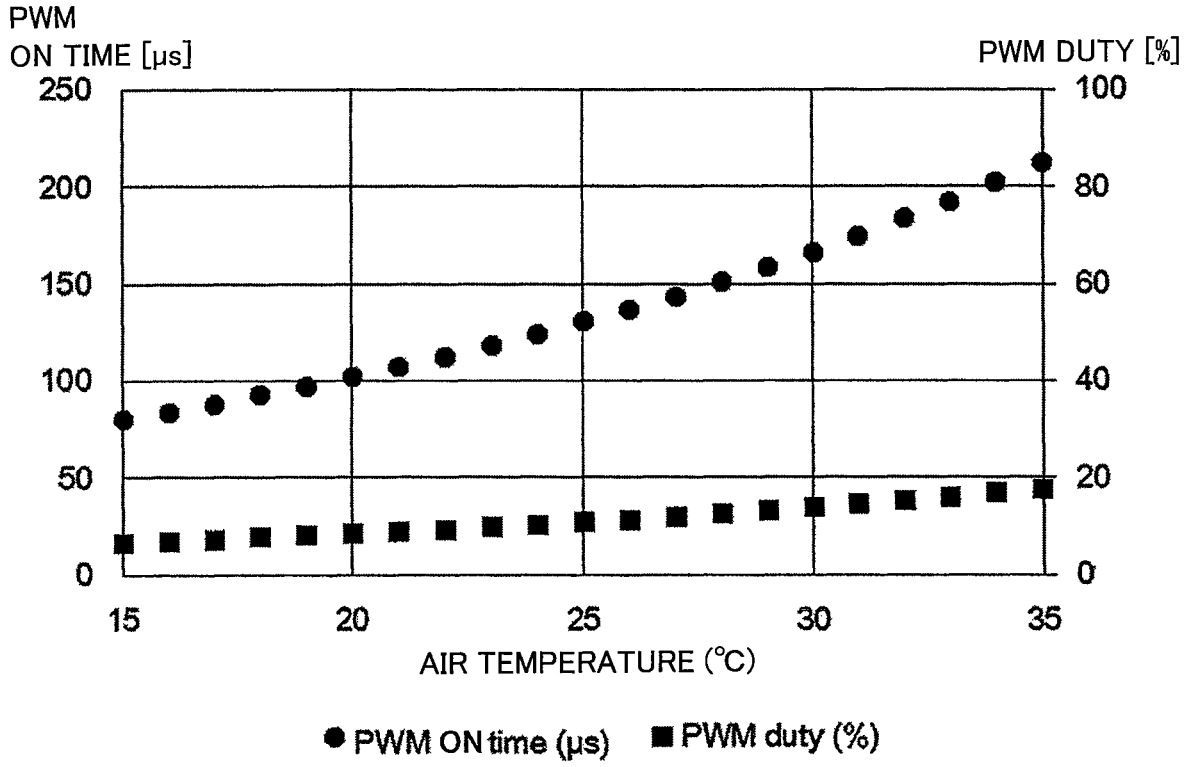
FIG. 20 is a diagram showing the setting of the PWM signal used in the above-described FIG. 19.

FIG. 20 is a diagram showing the setting of the PWM signal used in the above-described FIG. 19. In FIG. 20, the horizontal axis represents the air temperature (temperature) T. Also, the left-side vertical axis represents PWM_ON_time(T) and the right-side vertical axis represents the duty cycle (PWM duty) of the PWM signal. Also in FIG. 20, $T_0$=15° C. and PWM_compensation rate=5/° C. similarly to FIG. 19.

As shown in FIG. 20, it was confirmed that the stability of spraying was maintained in the temperature range of between 15° C. and 35° C. by adjusting the duty cycle of the PWM signal according to the air temperature T.

In addition, it was confirmed that adjusting the duty cycle of the PWM signal shown in FIG. 20 caused the liquid sprayed from the tip portion 5 of the spray electrode 1 to form a Taylor cone shape at each of the temperatures of T=15° C., 25° C., and 35° C. That is, a good spray state and stable spray amount were confirmed in the temperature range 15° C. to 35° C.

Example of Compensation Based on Battery Voltage

In the above-described example, the compensation method in the case where the operation environment information includes information indicating the air temperature T (a specific example of information indicating the surrounding environment of the electrostatic spraying device 100) has been described. Subsequently, an example of a compensation method in the case where the operation environment information includes information (e.g., the measurement result of the voltage/current sensor 255) indicating the operation state of the power supply 21 will be given.

For example, the operation environment information may include information indicating the magnitude of at least one of voltage and current supplied from the power supply 21 to the high-voltage generation device 22 as information indicating the operation state of the power supply 21. Hereinafter, an example of the case where the operation environment information is information indicating the magnitude of the voltage (battery voltage) supplied from the power supply 21 to the high-voltage generation device 22 will be given. It is to be noted that the battery voltage may be measured by the voltage/current sensor 255.

Figure 21:
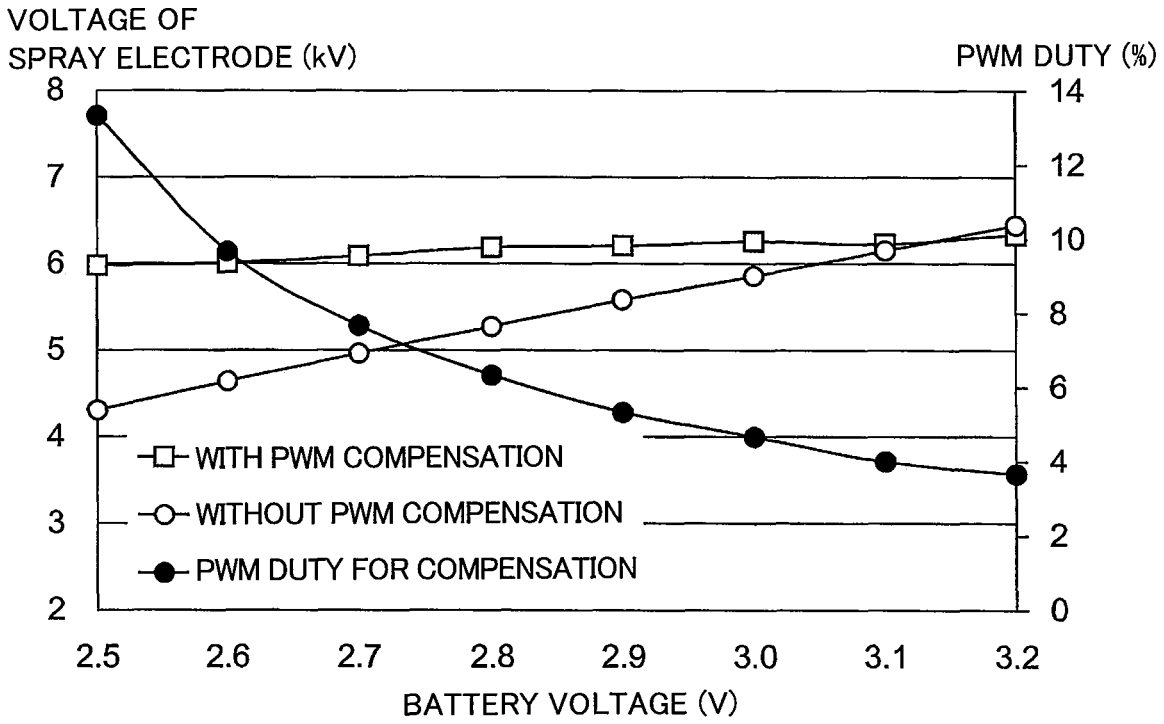
FIG. 21 is a diagram showing an example of compensation based on the battery voltage.

FIG. 21 is a diagram showing an example of compensation based on the battery voltage. In FIG. 21, the horizontal axis represents the battery voltage. Also, the left-side vertical axis represents the voltage of the spray electrode 1 and the right-side vertical axis represents the duty cycle (PWM duty) of the PWM signal. It is to be noted that the initial value of the battery voltage is assumed to be 3.2 V.

As described above, the battery voltage gradually decreases with the lapse of time. Therefore, as shown in the legend of "without PWM compensation" in FIG. 21, unless the duty cycle of the PWM signal is adjusted, the voltage of the spray electrode 1 also decreases as the battery voltage decreases. For this reason, the stability of spray may be impaired in a case where the battery voltage becomes low to some extent.

Then, as shown in the legend of "with PWM compensation" in FIG. 21, the inventor of the present application found a new compensation scheme for adjusting the duty cycle of the PWM signal as the battery voltage decreases.

Specifically, when the battery voltage decreases, the control circuit 24 adjusts the duty cycle so as to increase the duty cycle of the PWM signal. As a result, even if the battery voltage decreases with the lapse of time, the voltage of the spray electrode 1 can be kept constant (about 6 kV), so that the stability of spray can be maintained.

Effect of Electrostatic Spraying Device 100

As described above, in the electrostatic spraying device 100 of the present embodiment, the control circuit 24 controls the output power of the high-voltage generation device 22 based on the operation environment information indicating at least one of (i) the surrounding environment of the electrostatic spraying device 100 and (ii) the operation state of the power supply 21, independently of the current value and the voltage value at the spray electrode 1 and the reference electrode 2. This makes it possible to realize an electrostatic spraying device excellent in spray stability with a simple structure.

It is to be noted that the present embodiment exemplifies a case in which the output power control is performed by adjusting the duty cycle of the PWM signal. However, as will be described in the second embodiment below, it is also possible to perform the output power control by a method other than PWM.

Second Embodiment

Hereinafter, the second embodiment of the present invention will be described on a basis of FIGS. 22 and 23.

Figure 22:
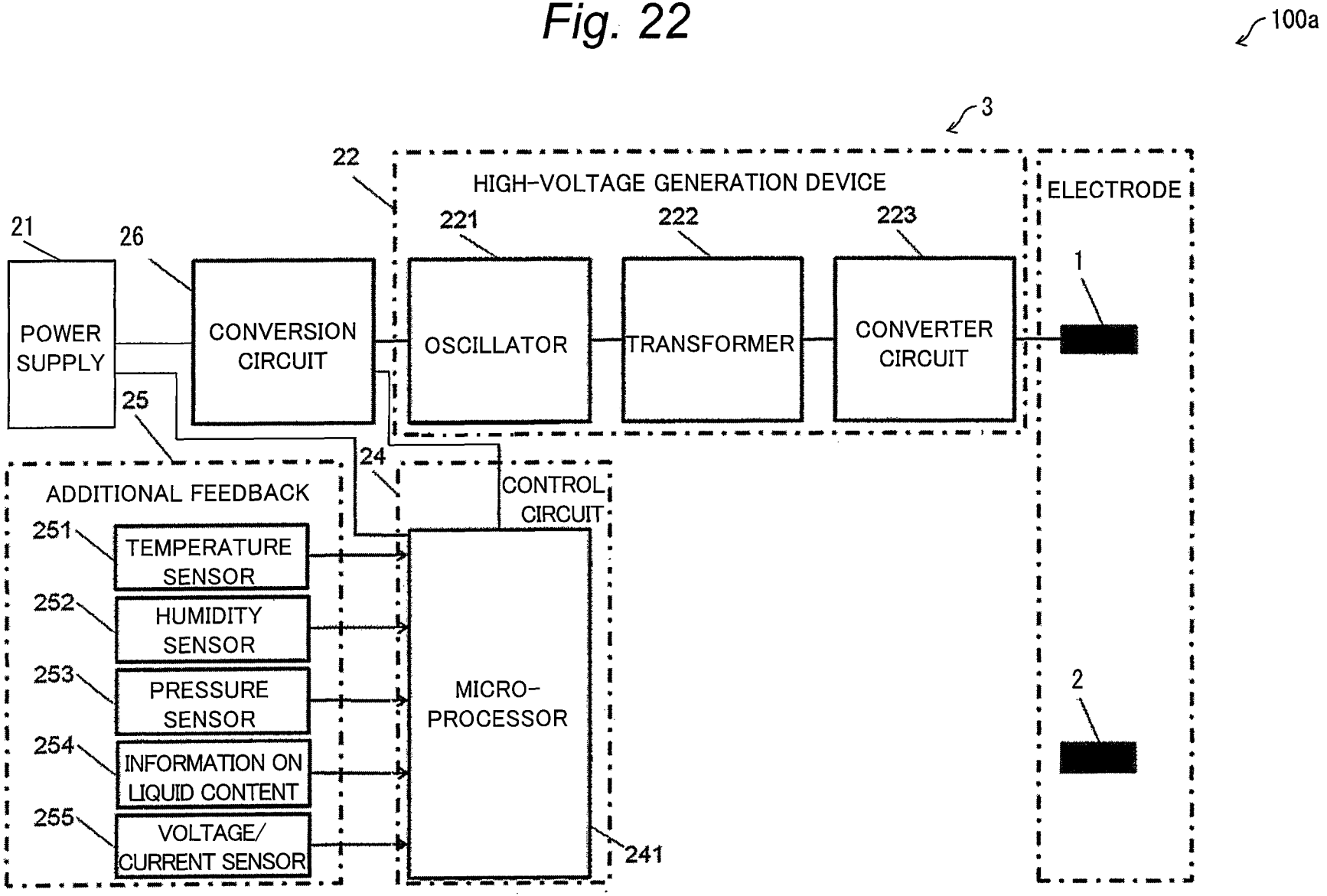
FIG. 22 is a configuration diagram of an electrostatic spraying device according to the second embodiment of the present invention.

FIG. 22 is a configuration diagram of an electrostatic spraying device 100*a* of the present embodiment. It is to be noted that in the following, only the differences from the electrostatic spraying device 100 of FIG. 1 will be described.

As shown in FIG. 22, the electrostatic spraying device 100*a* is different from the electrostatic spraying device of the first embodiment in the respects of (i) having a conversion circuit 26 and (ii) not outputting a PWM signal from the control circuit 24 to the oscillator 221. As described below, the electrostatic spraying device 100*a* is configured to perform output power control by a method other than PWM.

The conversion circuit 26 is a circuit that converts the magnitude of the voltage supplied from the power supply 21 to the high-voltage generation device 22. The conversion circuit 26 is, for example, a DC/DC converter. In addition, the conversion circuit 26 is provided between the power supply 21 and the high-voltage generation device 22.

Specifically, the conversion circuit 26 converts a DC (direct-current) voltage V1 (battery voltage as an input voltage) input from the power supply 21 into a DC voltage V2 (output voltage) having a different magnitude. Then, the conversion circuit 26 supplies the voltage V2 to the high-voltage generation device 22 (more specifically, the oscillator 221). Here, K=V2/V1 is referred to as the conversion magnification of the voltage in the conversion circuit 26.

Figure 23:
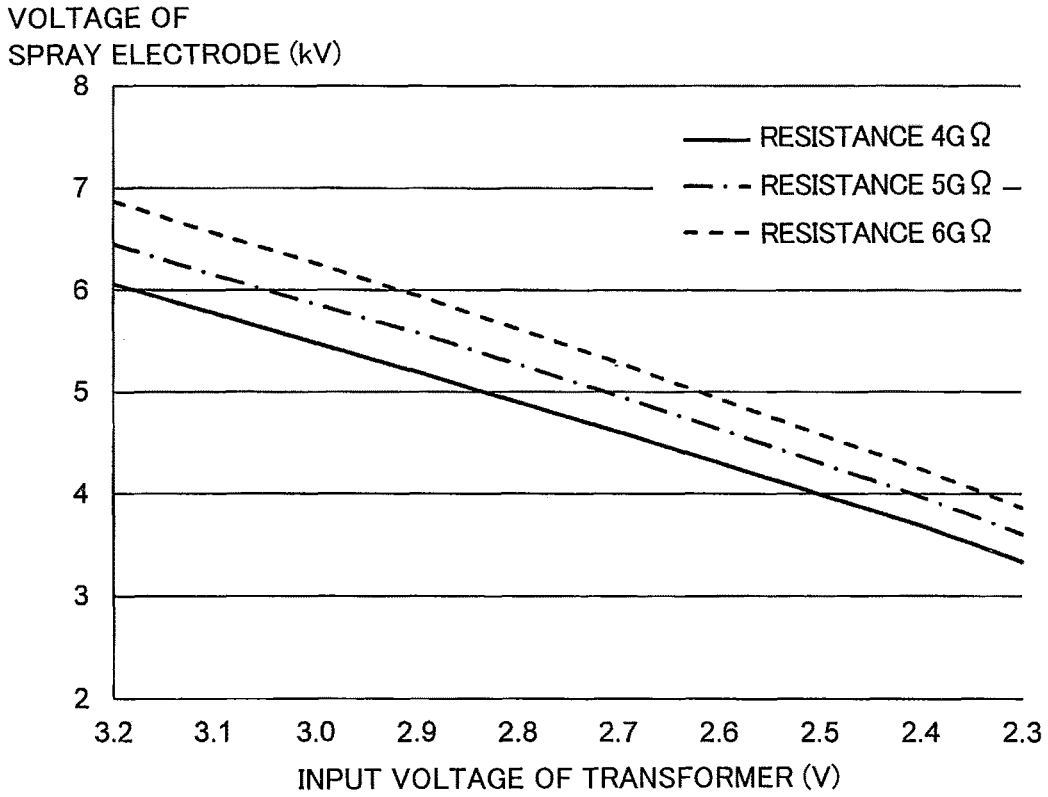
FIG. 23 is a diagram showing the relationship between the input voltage of a transformer and the voltage of a spray electrode in the second embodiment of the present invention.

FIG. 23 is a diagram showing the relationship between the input voltage of the transformer 222 (in other words, the output voltage of the oscillator 221) and the voltage of the spray electrode 1. In FIG. 23, the horizontal axis represents the input voltage of the transformer 222, and the vertical axis represents the voltage of the spray electrode 1. In addition, FIG. 23 shows the relationship between the input voltage of the transformer 222 and the voltage of the spray electrode 1 in the three cases where the resistance value of the spray electrode 1 is "4 GΩ", "5 GΩ", and "6 GΩ".

As shown in FIG. 23, it was confirmed that for each resistance value of the spray electrode 1, as the input voltage of the transformer 222 becomes smaller, the voltage of the spray electrode 1 becomes smaller. Similarly, it was confirmed that as the input voltage of the transformer 222 becomes greater, the voltage of the spray electrode 1 becomes greater.

Hence, according to FIG. 23, it is understood that the voltage of the spray electrode 1 can maintain to a substantially constant value (e.g., 6 kV) by properly adjusting the input voltage of the transformer 222. In other words, the output power control described above can be performed by changing the input voltage of the transformer 222 without changing the duty cycle of the PWM signal.

In view of this point, the control circuit 24 in the present embodiment is configured to give the conversion circuit 26 a command to change (increase or decrease) the conversion magnification K. As described above, the oscillator 221 converts the DC voltage (the above-described voltage V2) input thereto to an AC voltage and supplies the converted AC voltage to the transformer 222. Therefore, the input voltage of the transformer 222 can be changed by changing the value of the voltage V2.

Here, since V2=K×V1, the input voltage of the transformer 222 can be changed by changing the above-described conversion magnification K by the control circuit 24. Then, as described above, the voltage of the spray electrode 1 is determined according to the input voltage of the transformer 222. In this way, the output power control can be performed by changing the conversion magnification K by the control circuit 24.

It is to be noted that the change of the conversion magnification K by the control circuit 24 is performed based on the operation environment information described above, independently of the current value and the voltage value in the spray electrode 1 and the reference electrode 2, similarly to the output power control of the first embodiment.

As an example, the change of the conversion magnification K in the control circuit 24 may be performed based on the magnitude of the battery voltage (an example of information indicating the operation state of the power supply 21). Further, the change of the conversion magnification K may be performed based on the above-described air temperature T (an example of information indicating the surrounding environment of the electrostatic spraying device 100*a*). Further, the conversion magnification K may be changed based on both the magnitude of the battery voltage and the air temperature T. It is to be noted that the conversion magnification K may be changed by further using information indicating the humidity, the pressure, the viscosity of the liquid, or the like as described above.

As described above, the electrostatic spraying device 100*a* of the present embodiment can perform output power control by changing the conversion magnification K described above. That is, the electrostatic spraying device 100*a* can perform output power control by a method other than changing the duty cycle of the PWM signal. Thus, with the electrostatic spraying device 100*a*, it is possible to realize an electrostatic spraying device excellent in spray stability by a simple structure, similarly to the first embodiment.

Additional Notes

The present invention is not limited to the above-described embodiments, and various modifications are possible within the scope indicated in the claims. That is, embodiments obtained by combining technical means appropriately changed within the scope of claims are also included in the technical scope of the present invention.

INDUSTRIAL APPLICABILITY

The present invention relates to an electrostatic spraying device.

REFERENCE SIGNS LIST

1 spray electrode (first electrode)
2 reference electrode (second electrode)
3 power supply device
5 tip portion
6 spray electrode attachment portion
7 reference electrode attachment portion
9 inclined surface
10 dielectric
11, 12 opening
21 power supply
22 high-voltage generation device (voltage applicator)
24 control circuit (controller)
25 feedback information (operation environment information)
26 conversion circuit
100, 100*a* electrostatic spraying device
221 oscillator
222 transformer
223 converter circuit
231 current feedback circuit
232 voltage feedback circuit
241 microprocessor
251 temperature sensor
252 humidity sensor
253 pressure sensor
254 information on the liquid content
255 voltage/current sensor
262 reference electrode

The invention claimed is:

1. An electrostatic spraying device that, by applying a voltage between a first electrode and a second electrode, sprays liquid from a tip of the first electrode, the electrostatic spraying device comprising:

a voltage applicator for applying the voltage between the first electrode and the second electrode; and a controller that controls an output power of the voltage applicator based on operation environment information indicating at least one of (i) a surrounding environment of the device and (ii) an operation state of a power supply that supplies power to the device, wherein the controller is configured to control the output independently from a current value and a voltage value at the first electrode and the second electrode.

2. The electrostatic spraying device according to claim 1, wherein:

the voltage applicator comprises:

an oscillator for converting a direct current supplied from the power supply into an alternating current;

a transformer connected to the oscillator and converting a magnitude of a voltage; and a converter circuit connected to the transformer and converting an alternating current into a direct current, wherein the controller outputs to the oscillator a PWM signal (pulse width modulation signal) of which a duty cycle is set to be constant.

3. The electrostatic spraying device according to claim 1, wherein the controller controls the output power according to a duty cycle of a PWM signal (Pulse Width Modulation signal).

4. The electrostatic spraying device according to claim 1, wherein the operation environment information includes information indicating at least one of air temperature, humidity and pressure around the device, and viscosity of the liquid, as information indicating the surrounding environment.

5. The electrostatic spraying device according to claim 4, wherein:

the operation environment information includes information indicating the air temperature around the device; and the controller controls the output power according to a duty cycle of a PWM signal, increases the duty cycle of the PWM signal in response to rising of the air temperature, and reduces the duty cycle of the PWM signal in response to dropping of the air temperature.

6. The electrostatic spraying device according to claim 5, wherein:

the controller determines a spray interval for which a period of time during which the device sprays the liquid and a period of time during which it stops spraying are one cycle, based on a following formula (1),

[Math. 1]

$$Sprayperiod(T) = \left(1 + \frac{T - T_0}{100} * \text{Sprayperiod_compensation_rate}\right) * Sprayperiod(T_0) \quad (1)$$

where,

Sprayperiod(T): Spray interval (s) for which the period of time during which the device sprays the liquid and the period of time during which it stops spraying at temperature T are one cycle T: Air temperature (° C.)

$T_0$: Initial setting temperature (° C.)

Sprayperiod_compensation_rate: Spray time compensation rate (-)

Sprayperiod(To): Spray interval (s) for which the period of time during which the device sprays the liquid and the period of time during which it stops spraying at the initial setting temperature $T_0$ are one cycle.

7. The electrostatic spraying device according to claim 5, wherein:

the controller determines a period of time for turning on the PWM signal based on a following formula (2),

[Math. 2]

$$\text{PWM_ON_time}(T) = \left(1 + \frac{T - T_0}{100} * \text{PWM_compensation_rate}\right) * \text{PWM_ON_time}(T_0) \quad (2)$$

where,

PWM_ON_time(T): ON time (μs) of the PWM signal

T: Air temperature (° C.)

PWM_compensation rate: PWM compensation factor (/° C.)

PWM_ON_time($T_0$): ON time (μs) of the PWM signal at initial setting temperature $T_0$.

8. The electrostatic spraying device according to claim 5, wherein:

the controller increases a spray interval for which a period of time during which the device sprays the liquid and a period of time during which it stops spraying are one cycle and increases the duty cycle of the PWM signal in response to rising of the air temperature, and reduces the spray interval for which the period of time during which the device sprays the liquid and the period of time during which it stops spraying are one cycle and reduces the duty cycle of the PWM signal in response to dropping of the air temperature.

9. The electrostatic spraying device according to claim 1, wherein the operation environment information includes information indicating a magnitude of at least one of a voltage and a current supplied from the power supply to the voltage applicator, as information indicating the operation state of the power supply.

10. The electrostatic spraying device according to claim 1, further comprising:

a conversion circuit for converting a magnitude of a voltage supplied from the power supply to the voltage applicator, wherein:

the conversion circuit is provided between the power supply and the voltage applicator, and the controller controls the output power by giving, to the conversion circuit, a command to increase or decrease a conversion magnification of the voltage in the conversion circuit.

* * * * *